US005430962A

United States Patent [19]

Osadchuk

[11] Patent Number: 5,430,962

[45] Date of Patent: Jul. 11, 1995

[54] PIPELINE PADDING APPARATUS WITH ROTARY FEEDER

[75] Inventor: Mark Osadchuk, Scottsdale, Ariz.

[73] Assignee: Ozzie's Pipeline Padder, Inc., Scottsdale, Ariz.

[21] Appl. No.: 68,766

[22] Filed: May 12, 1993

Related U.S. Application Data

[60] Continuation-in-part of Ser. No. 34,133, Mar. 22, 1993, Pat. No. 5,363,574, which is a division of Ser. No. 538,924, Jun. 15, 1990, Pat. No. 5,195,260, which is a continuation-in-part of Ser. No. 255,720, Oct. 11, 1988, abandoned.

[51] Int. Cl.[6] ..... E02F 5/22

[52] U.S. Cl. ..... 37/142.5; 405/179; 209/241

[58] Field of Search ..... 37/304, 305, 306, 390, 37/392, 237, 142.5, 189, 190, 462, 908, 219, 220, 241; 405/179

[56] References Cited

U.S. PATENT DOCUMENTS

| | | | |
|---|---|---|---|
| 584,112 | 6/1897 | Greenerd | 37/190 X |
| 758,624 | 5/1904 | Dobson | 37/190 |
| 1,681,089 | 7/1927 | Bottomley . | |
| 1,690,009 | 10/1928 | Hamilton . | |
| 2,595,398 | 5/1952 | Lewis . | |
| 2,669,338 | 2/1954 | Kling . | |
| 2,696,287 | 12/1954 | Foust . | |
| 2,708,800 | 5/1955 | Logus . | |
| 2,814,387 | 11/1957 | McWilliams . | |
| 2,857,691 | 10/1958 | Curran . | |
| 2,947,096 | 8/1960 | Cummings et al. . | |
| 3,030,080 | 4/1962 | Hise et al. . | |
| 3,105,311 | 10/1963 | Hait | 37/304 |
| 3,190,697 | 6/1965 | Gonski . | |
| 3,210,122 | 10/1965 | Moon . | |
| 3,256,973 | 6/1966 | Gonski . | |
| 3,277,993 | 10/1966 | Arndt . | |
| 3,308,563 | 3/1967 | Danek . | |
| 3,316,977 | 5/1967 | Snook . | |
| 3,340,935 | 9/1967 | Csimma . | |
| 3,362,518 | 1/1968 | Sibley . | |
| 3,396,481 | 8/1968 | Hovorak . | |
| 3,452,461 | 7/1969 | Hanson | 37/189 |
| 3,473,243 | 10/1969 | Turner | 37/189 |
| 3,479,755 | 11/1969 | Schropp . | |
| 3,503,450 | 3/1970 | Day . | |
| 3,701,422 | 10/1972 | Downey . | |
| 3,860,291 | 1/1975 | Rauch et al. . | |
| 3,874,182 | 4/1975 | Potter et al. | 405/179 |

(List continued on next page.)

FOREIGN PATENT DOCUMENTS

| | | |
|---|---|---|
| 1312124 | 12/1989 | Japan . |
| 1294930 | 3/1987 | U.S.S.R. . |

*Primary Examiner*—Randolph A. Reese
*Assistant Examiner*—Victor Batson
*Attorney, Agent, or Firm*—Crutsinger & Booth

[57] ABSTRACT

An improved pipeline padding apparatus includes a separator for separating fine material out of spoil which is piled along side an excavation, an elevator for transporting spoil to the separator, and a pair of spaced-apart guide projections for guiding spoil into the elevator. The spaced-apart guide projections form a substantially open bottom extending the width of the elevator between the guide projections. A conveyor is provided to transport the separated fine portion of the spoil back into the excavation, thereby padding the pipeline. The separator, the elevator, the guide projections, and the vehicle are all mounted on a support vehicle. According to one aspect of the invention, one or more rotary feeder assemblies is mounted to the guide projections for assisting in moving spoil through toward the elevator. The rotary feeder assemblies have a low profile so that spoil material and rocks do not become stuck as they move toward the elevator. In another aspect of the invention, the motor of the tracked support vehicle is mounted above and forward of the elevator, which helps reduce the mount of dust that the motor is exposed to during operation. According to another aspect of the invention, the guide projections may be configured to allow excess spoil to flow underneath in such a manner as to smooth out a path for the tracks of the support vehicle.

18 Claims, 19 Drawing Sheets

U.S. PATENT DOCUMENTS 3,892,443 7/1975 Arentzen .
3,981,089 9/1976 Burrows .
4,055,255 10/1977 Vasquez .
4,057,917 11/1977 Burrows .
4,123,857 11/1978 Enters et al. .
4,133,582 1/1979 Kogelmann .
4,159,055 6/1979 Eberle .
4,277,105 7/1981 Taylor .
4,287,692 9/1981 Alexander et al. .
4,616,957 10/1986 Burrows et al. ..... 405/179
4,633,602 1/1987 Layh et al. .
4,664,791 5/1987 McClain et al. .
4,795,552 1/1989 Yun et al. .
4,825,569 5/1989 Porter ..... 405/179 X
4,864,748 9/1989 Boyer .
4,912,862 4/1990 Bishop et al. .
4,948,299 8/1990 Cronk, Jr. et al. .
4,955,756 9/1990 Klamar ..... 405/179
5,084,991 2/1992 Cronk, Jr. .
5,097,610 3/1992 Bishop .
5,120,433 6/1992 Osadchuk .
5,183,160 12/1993 McClain ..... 405/179 X
5,195,260 3/1993 Osadchuk .
5,259,699 11/1993 Klamar ..... 405/179

Figure 15
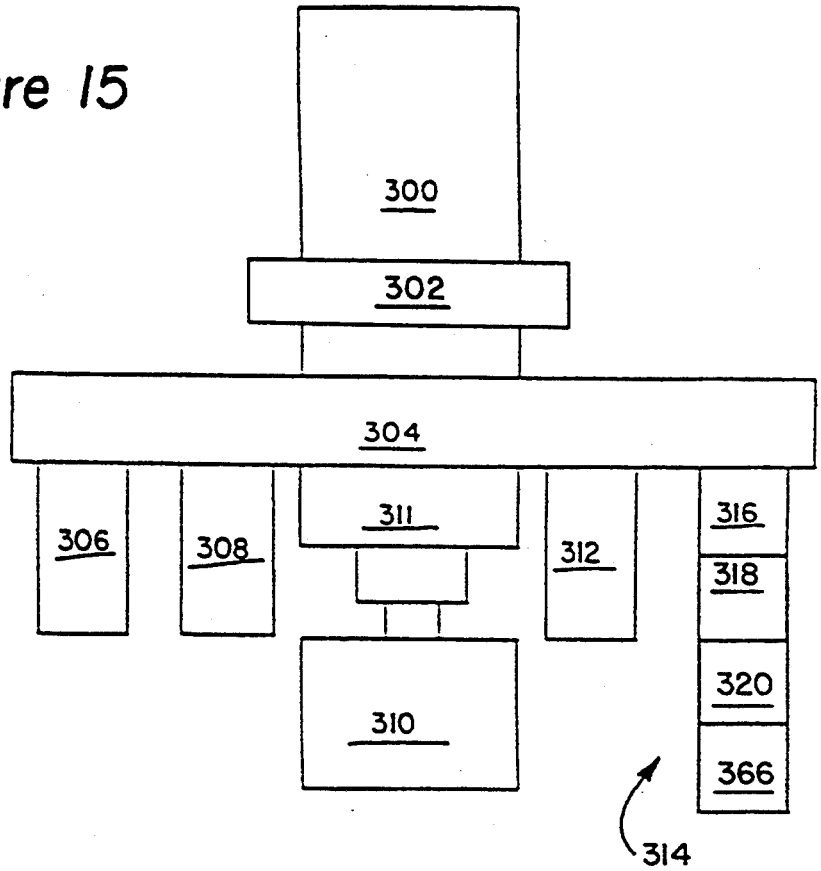
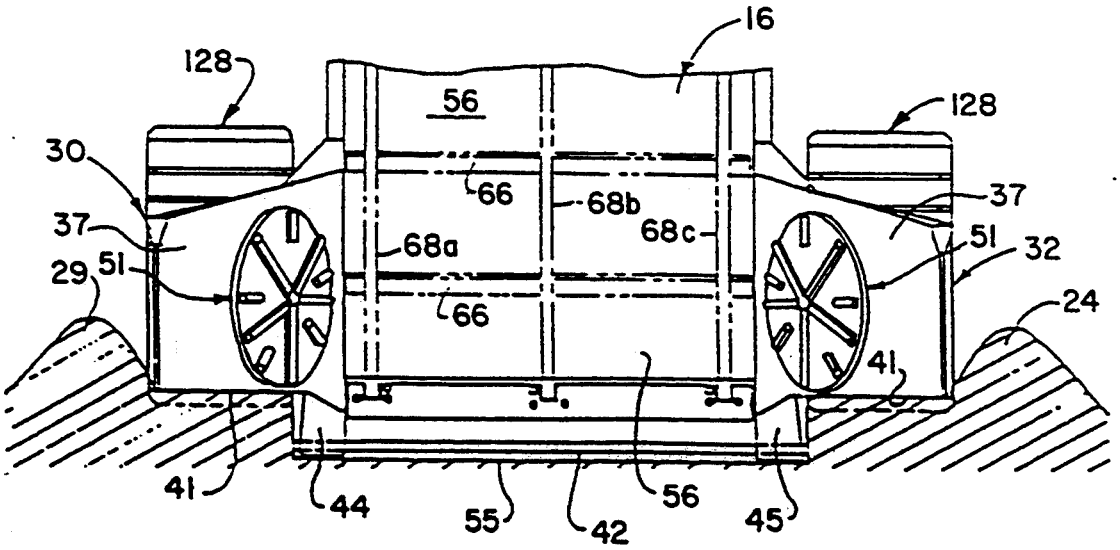
Figure 18

PIPELINE PADDING APPARATUS WITH ROTARY FEEDER

CROSS-REFERENCE TO RELATED APPLICATIONS

This application is a Continuation-In-Part of U.S. application Ser. No. 08/034,133, now U.S. Pat. No. 5,363,574, filed Mar. 22, 1993, which is a Division of U.S. application Ser. No. 07/538,924, filed Jun. 15, 1990, now U.S. Pat. No. 5,195,260, which is a Continuation-In-Part of U.S. application Ser. No. 07/255,720, filed Oct. 11, 1988, now abandoned.

FIELD OF THE INVENTION

The present invention relates to an apparatus for padding pipe. More particularly, the invention relates to improvements in pipeline padding apparatus that more efficiently collects and loads earth material for processing into padding material for padding a pipeline.

BACKGROUND OF THE INVENTION

A large demand exists in contemporary society for underground piping, which is used to convey fluids from one location to another. The pipeline is buried to protect it, and it is also usually coated with a plastic or other protective material to extend the life of the pipeline by preventing corrosion.

To lay an underground pipeline, a back hoe, trencher or the like is used to create an excavated trench, and the excavated soil and rock, which is commonly called spoil, is piled to one side of the excavation. The pipeline is then laid in the excavation. After the pipeline is laid in the excavation, it must be covered with earth material. However, it is important that rocks in the spoil do not come into contact with the pipeline, which could breach the protective coating and cause unnecessary corrosion of the pipeline. For this reason, it is common to fill in a portion of the excavation surrounding the pipeline with fine material, which is commonly called padding material. In the past, sand or other fine material usually had to be purchased from remote locations and hauled great distances to the pipeline location for this purpose. However, sand padding is labor intensive, and it also requires many trucks and loaders, which can cause problems along the narrow right-of-way of the pipeline project.

More recently, pipeline padding machines have been developed that move along the pile of excavated spoil and continuously collect spoil material, separate from the spoil fine material suitable for pipe padding, and convey the padding material into the excavation to pad the pipeline. These earlier padding machines were an improvement over sand hauling sand padding, however, the costs associated with pipeline construction and pipeline padding are considerable, and every increase in efficiency can translate to large savings in time and labor.

For example, the pipeline environment can present excavated spoil that is wet, sticky, and rocky, such spoil being difficult to load onto the machines for processing into padding material. Such spoil conditions can slow down the padding process. Thus, there is a need for improved padding apparatus that has better material handling ability and is more efficient at collecting and loading spoil material for processing into padding material.

SUMMARY OF THE INVENTION

A pipeline padding apparatus according to the invention includes: a support vehicle adapted for moving relative to an excavation and associated spoil; structure for elevating spoil material; structure for guiding spoil material toward the elevating structure as the vehicle is moved relative to the spoil; structure for separating the elevated spoil material into fine material and rough material; and structure for conveying the fine material separated from the spoil to the excavation. According to one aspect of the invention, the spoil guide structure further includes one or more powered rotary feeders for assisting in guiding and moving the spoil toward the elevator structure. Each rotary feeder has raised structures that engage the spoil and assist in moving the spoil through the spoil guide structure. The rotary feeders can be mounted to the spoil guide structure to have a low profile such that spoil material does not become compacted in the spoil guide structure around the rotary feeders. The rotary feeders can be mounted to the spoil guide structure in a variety of configurations to assist in guiding and moving the spoil toward the elevator. The present invention also relates to methods of using the new pipeline padding apparatus that includes rotary feeders.

These and various other advantages and features of novelty which characterize the invention are pointed out with particularity in the one or more claim annexed hereto and forming a part hereof. However, for a better understanding of the invention, its advantages, and the objects obtained by its use, reference should be made to the detailed description and drawings which form a further part hereof, in which there is described and illustrated preferred embodiments of the invention.

BRIEF DESCRIPTION OF THE DRAWINGS

FIG. 15 is a schematic depiction of the mechanical hydraulic pump drive used in the embodiment of FIG. 1;

FIG. 18 is a front diagrammatical view illustrating operation of the pipeline padding assembly illustrated in FIG. 1;

DETAILED DESCRIPTION OF THE PREFERRED EMBODIMENTS

THE EMBODIMENT OF FIGS. 1-19

Figure 1:
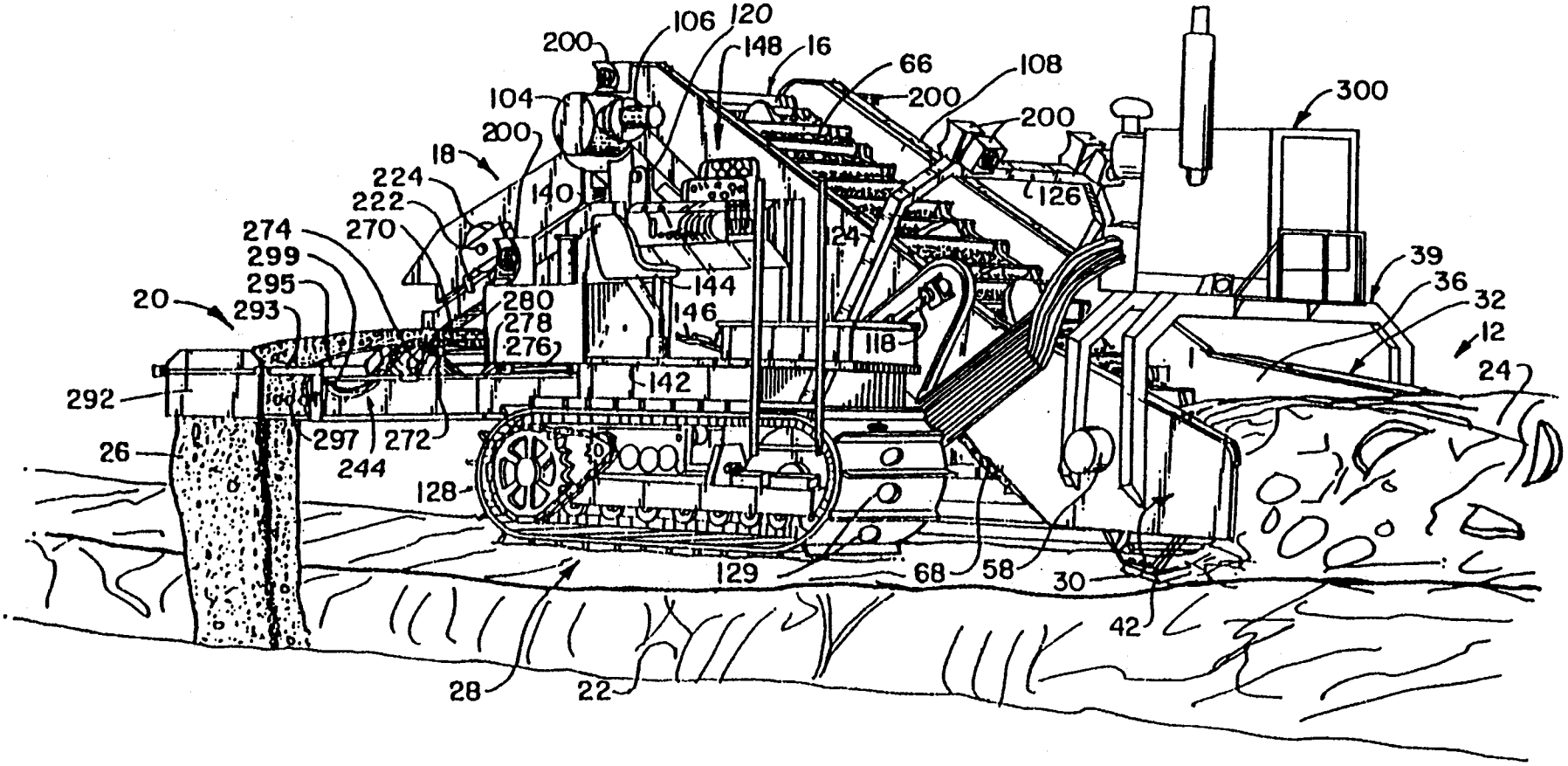
FIG. 1 is a side perspective view of a pipeline padding assembly constructed according to a first embodiment of the invention in a first operating position.

Referring now to the drawings, wherein like reference numerals designate corresponding elements throughout the views, and particularly referring to FIGS. 1-19, an improved pipeline padding assembly according to a first preferred embodiment of the invention is illustrated.

Figure 2:
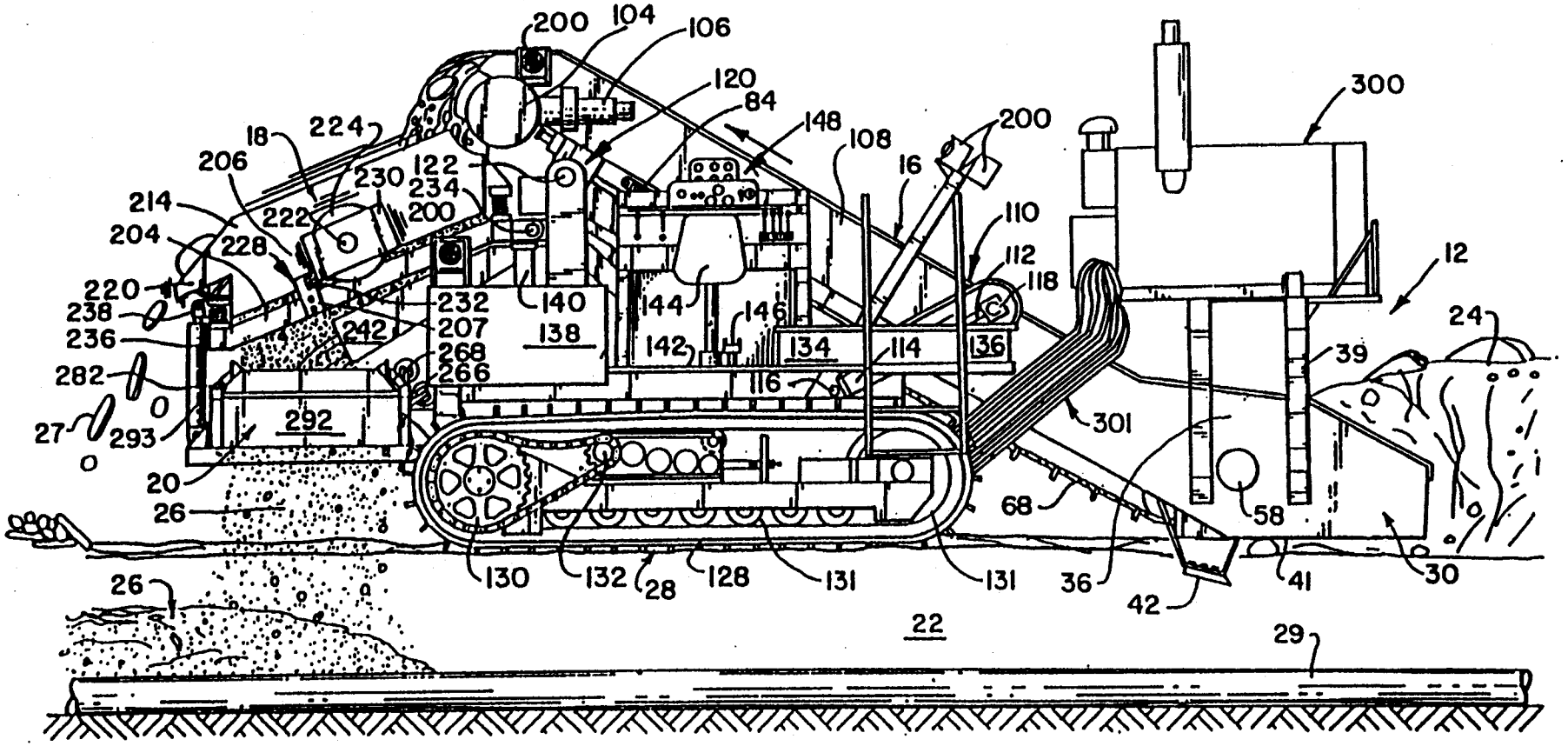
FIG. 2 is a side elevation view of the pipeline padding assembly illustrated in FIG. 1.
Figure 3:
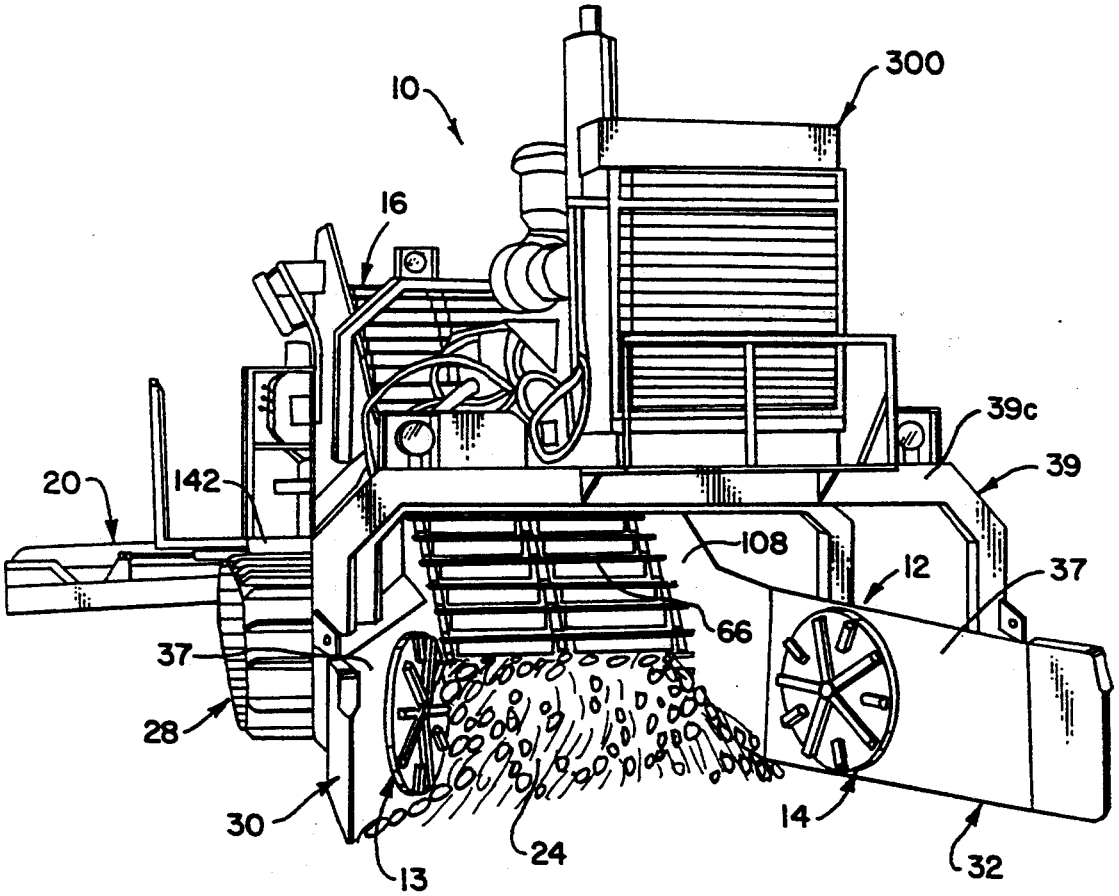
FIG. 3 is a front perspective view of the pipeline padding assembly illustrated in FIG. 1.

Referring first to FIGS. 1 and 2, pipeline padding assembly 10 is adapted to be positioned adjacent an excavation 22 so that a spoil guide assembly 12 on assembly 10 is adjacent a pile of spoil 24 which has been removed from excavation 22. As is best seen in FIG. 3, right and left rotary feeder assemblies 13, 14, respectively, are provided for assisting in moving spoil through the spoil guide assembly 12 and toward an elevator or transporting assembly 16. (For the purposes of this description, references to "right" and "left" are from the perspective of an operator on the assembly 10 looking in the direction of forward motion.) Referring back to FIGS. 1 and 2, elevator assembly 16 conveys the spoil in an elevating direction and drops the spoil onto a separator assembly 18. As best shown in FIG. 2 and described in detail below, separator assembly 18 separates the spoil into fine material 26 and rough material 27 and allows the Fine material 26 to drop down onto a conveyor assembly 20. Separator assembly 18 conveys the fine material 26 into the excavation 22 in order to pad the pipeline 29 therein. The rough material 27 can be conveyed behind the assembly 10.

As is shown in FIG. 1, spoil guide assembly 12, elevator assembly 16, separator assembly 18, and conveyor assembly 20 are mounted for movement on a self-propelled vehicle 28. Vehicle 28 provides vehicular support for the above-identified elements. As used herein, the term "vehicle" is used in its ordinary sense and meaning to refer to any structure for use in transporting something, and includes tracked or wheeled vehicles. As a result, the entire assembly 10 may be moved along side an excavation in order to quickly and efficiently pad a pipeline.

Figure 19:
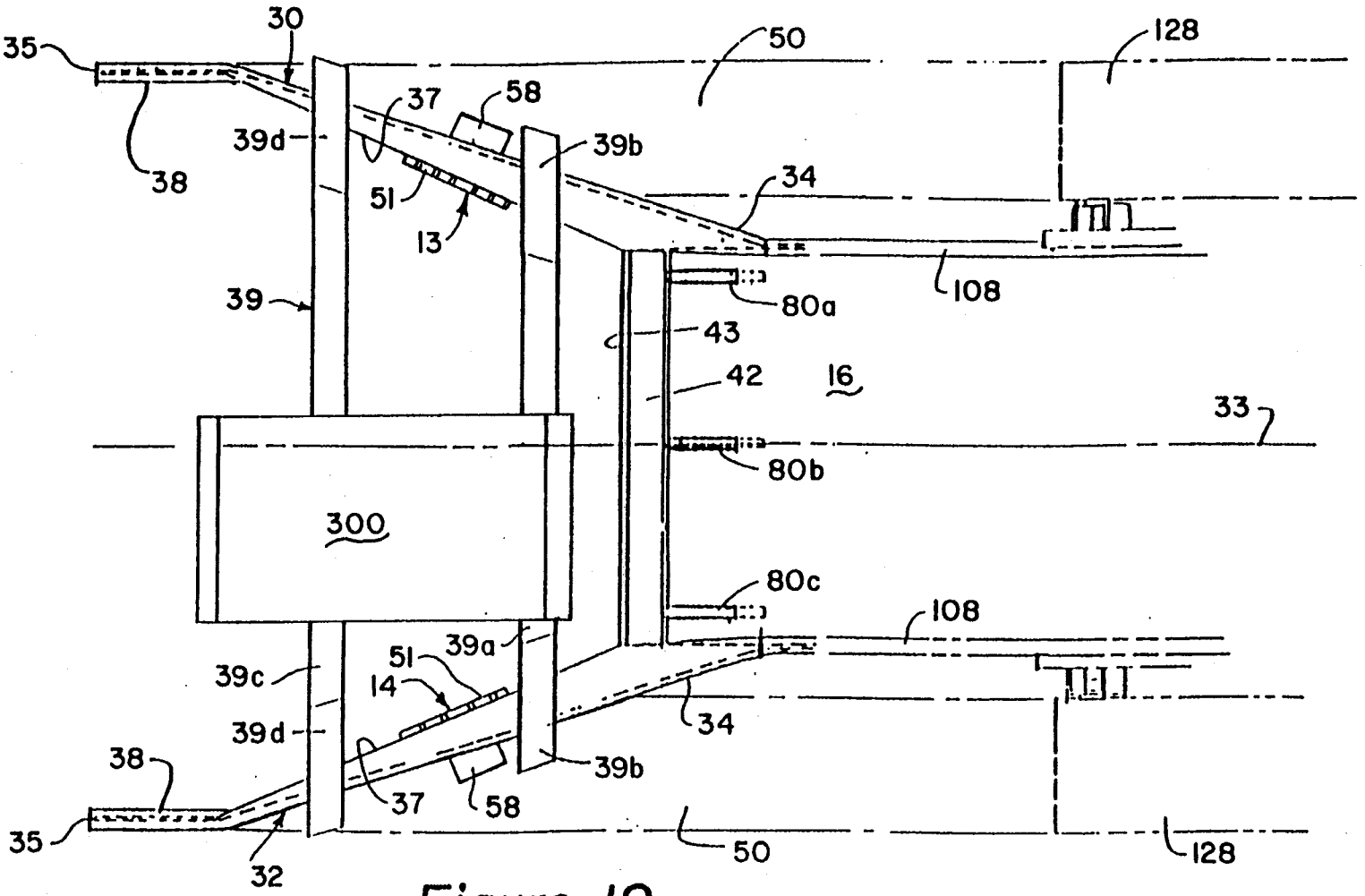
FIG. 19 is a top diagrammatical view depicting the operation of a pipeline padding assembly constructed according to the embodiment shown in FIG. 1.

As best shown in FIG. 3, spoil guide assembly 12 includes a first guide projection 30 and a second guide projection 32. In the illustrated embodiment, first and second guide projections 30, 32 are unitary with elevator side guard portions 108 of the elevator assembly 16. Referring briefly to FIG. 19, first and second guide projections 30, 32 flare outwardly from a center line 33 which would bisect elevator assembly 16 in the elevating direction. As will be described in more detail, each of the first and second guide projections 30, 32 preferably includes a lower, ground engaging surface which is formed to be substantially flat and parallel to the surface upon which self-propelled vehicle moves, although the actual position of the ground engaging surface varies in accordance with the position of elevator assembly 16. Referring back to FIGS. 1 and 2, each of the projections 30, 32 further include an upwardly projecting side guard portion 36 which prevents spoil from spilling thereover, which might result in damage to the pipeline 29 in the excavation. As shown in FIGS. 3 and 19, guide projections 30, 32 form an open bottomed structure for the spoil.

Continuing to look to FIG. 19, the first and second guide projections 30, 32 each have a first end 34, which is unitary with the forward end elevator sideguard portions 108 of elevator assembly 16, and a second end 35, which constitutes a forward leading edge of the guide projection. First and second guide projections 30, 32 each also have a first guide surface portion 37 and second guide surface portion 38. As may be best seen in FIG. 19, the first guide surface portion 37 on each of the guide projections 30, 32 is contained within a plane which is angled forwardly and outwardly with respect to a vertical plane containing a central axis 33 of the elevator assembly 16 so that first guide surface portion 37 directs spoil inwardly toward the central axis 33 when support vehicle 28 moves forward during operation. The second guide surface portions 38 of guide projections 30, 32 face opposite to one another, as may be seen in FIG. 19, so that the second guide surface portions 38 are preferably contained within respective planes which are substantially parallel to the vertical plane which contains the central axis 33 of elevator assembly 16. An overhead structural support 39 is provided which rigidly connects the first and second guide projections 30, 32 and supports the hydraulic engine section, as will hereinafter be described in detail.

Figure 6:
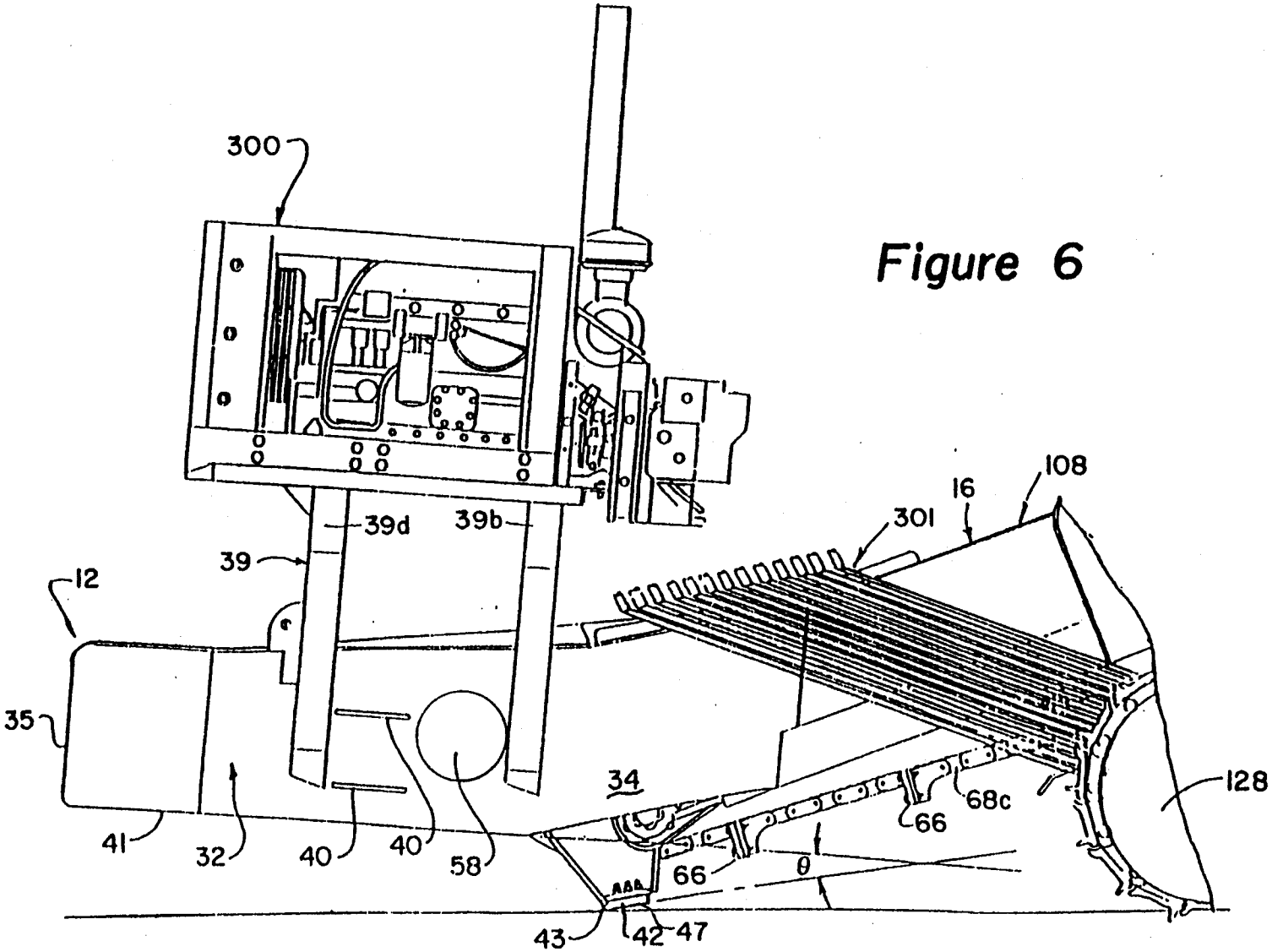
FIG. 6 is a side elevation view of the forward end of the pipeline padding assembly of FIG. 1.

As may be seen in FIGS. 6 and 18, each of the first and second guide projections 30, 32 has a bottom edge 41. Bottom edges 41 are positioned above the level of cutter element 42. As a result, bottom edges 41 are usually elevated with respect to the underlying ground surface during operation of the apparatus, since cutter element 42 is usually at or above ground level. This allows excess spoil to pass beneath bottom edges 41 as the support vehicle 28 moves forward. Preferably, the bottom edges 41 are substantially continuous and flat from the first end 34 to the second end 35 of each of the guide projections 30, 32 so that the spoil which escapes beneath each of the bottom edges 41 is smoothed out during operation to provide a stable surface upon which support vehicle 28 can ride. The bottom edges 41 provide smooth and stable surfaces 50 shown in FIG. 19 in the path of the tracks or wheels on the vehicle and that are each preferably at least as wide as the tracks or wheels on either side of the vehicle 28. As best shown in FIGS. 6 and 18, the bottom edges 41 may be the lowermost edge of guide projections 30, 32, or the bottom edges may be part of the planar, bottom surface of the guide projections 30, 32.

As is illustrated in FIGS. 6 and 18, the elevator assembly 16 includes a cutter element 42 positioned at the front lower end thereof. The cutter element 42 extends below the first guide projection 30 and second guide projection 32 in order to help separate spoil from an underlying surface. As shown in FIGS. 6, the cutter element 42 is mounted to a forward end of elevator assembly 16 by a fight cutter mount projection 44 and a left cutter mount projection 45. As may be seen in FIG. 6, cutter element 42 has a sharpened front edge 43 which is positioned beneath elevator assembly 16 so as to deflect rocks or like material upwardly toward the elevator assembly 16 during operation. In this way, large rocks or other articles of this nature are less likely to pass between the bottom end of elevator assembly 16 and the ground. Such objects could otherwise damage the support vehicle 28. Another purpose of cutter element 42 is that it stabilizes the elevator assembly 16 relative to the spoil during operation, through a spoiler-type effect. As best shown in FIG. 6, cutter element 42 is positioned downwardly and rearwardly with respect to guide projections 30, 32.

Figure 9:
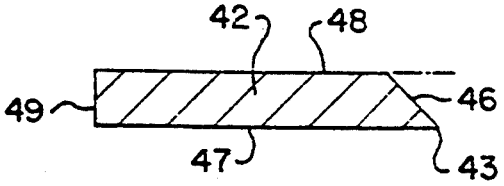
FIG. 9 is a cross-section view of the cutter element shown in FIG. 6.

As is best shown in FIG. 9, cutter element 42 includes a sharpened front edge 43 which is formed at an intersection of an inclined forward surface 46 with a flat bottom surface 47. Cutter element 42 further includes a flat top surface 48 and a flat rear surface 49. As may be seen in FIG. 6, the flat bottom surface 47 of cutter element 42 is preferably disposed at a fixed angle $\theta$ with respect to the bottom edges 41 of guide projections 30, 32. Preferably, angle $\theta$ is within the range of 5 to 25 degrees, and is most preferably about 12 degrees.

Figure 7:
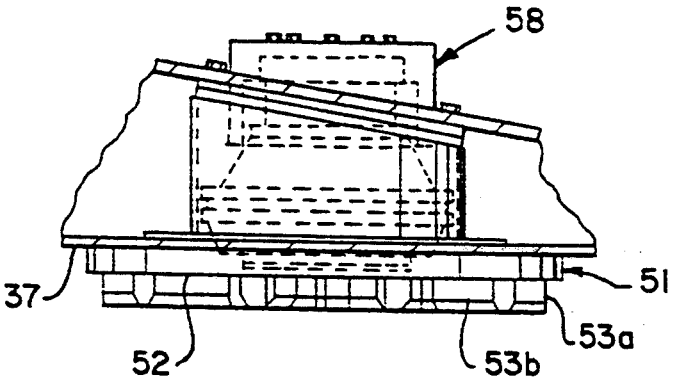
FIG. 7 is a section view of a rotary feeder assembly mounted in a guide projection of the apparatus shown in FIG. 1.
Figure 8:
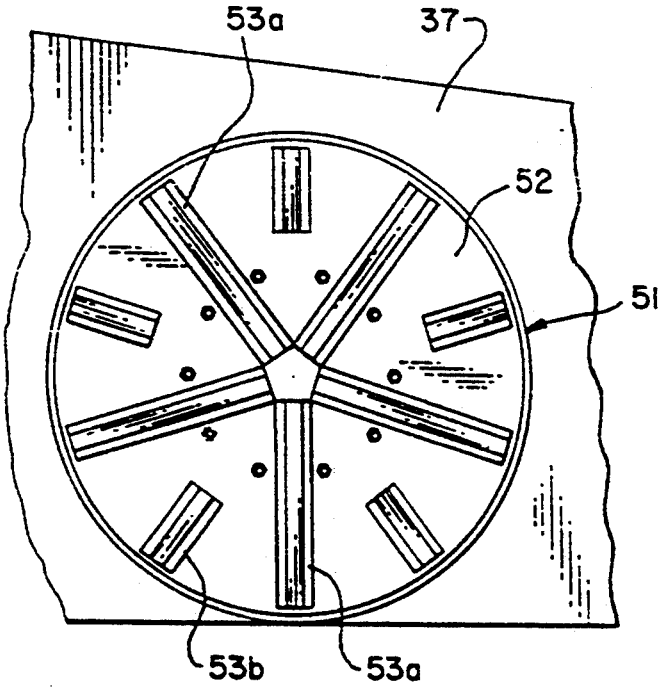
FIG. 8 is a detail view of the exposed portion of the rotary feeder assembly shown in FIG. 7.

Referring now to FIG. 3, a right rotary feeder assembly 13 and a left rotary feeder assembly 14 are mounted in the first and second guide projections 30, 32, respectively. As shown in FIGS. 7 and 8, each of the right and left rotary feeder assemblies 13, 14 include a rotor element 51. The rotor element 51 includes a base plate portion 52 and a plurality of radially oriented raised paddles 53*a*, 53*b* for engaging and moving the spoil. The rotor element 51 is preferably mounted to the first guide surface portions 37 of the spoil guide assembly 12. As best shown in FIG. 7, the rotor element 51 is mounted so that the base plate portion 52 is slightly raised from the surface of the first guide surface portions 37. The powered rotor elements 51 operate to provide more uniform movement and flow of spoil material through the spoil guide assembly 12.

Referring to FIG. 18, in a most preferred embodiment, the diameter of the largest circumferencial edge of a rotor element 51 is about 16 inches (40 centimeters). The distance between the largest circumferencial edge of one of the rotor elements 51 and the cutter element 42 is about 30 inches (75 centimeters), and the distance between the largest circumferencial edge of the rotor element 51 and the lowermost flat member 66 of elevator assembly 16 is about 18 inches (45 centimeters). However, it is contemplated by the present invention that rotor elements could have different sizes and the exact placement of the rotary feeder assemblies is not critical to the practice of the invention.

The rotor elements 51 are removable such that they can be replaced if they become worn. Furthermore, the raised paddles of the rotor elements can be designed in different configurations. For example, the raised paddles could be made to have a generally curved structure, or the rotor elements could be made with a plurality of raised studs instead of paddles.

Referring to FIG. 19, right rotary feeder assembly 13 is driven by hydraulic motor 58 that is mounted into the guide projection 30. Left rotary feeder assembly 14 is mounted into the guide projection 32 and is provided with a similar motor and drive arrangement. Because of the orientation of the hydraulic motors 58 mounted in the guide projections 30, 32, the hydraulic lines to hydraulic motors 58 can be advantageously passed through an outwardly facing wall of the guide projections. A control system is provided for controlling operation of both of these motors, as is below described. The control system allows the rotary elements 51 to be rotated either clockwise or counterclockwise, as desired, and at variable speeds. The direction of and speed of rotation can be changed to dislodge spoil material or rock or to provide more efficient movement of spoil through the spoil guide assembly 12. The operation of right and left rotary feeder assemblies 13, 14 in the open bottom configuration of the spoil guide assembly 12 assists in directing spoil toward the center of elevator assembly 16, and further in the elevating direction. The powered rotor elements 51 operate to provide more uniform movement and flow of spoil material through the spoil guide assembly 12.

Figure 5:
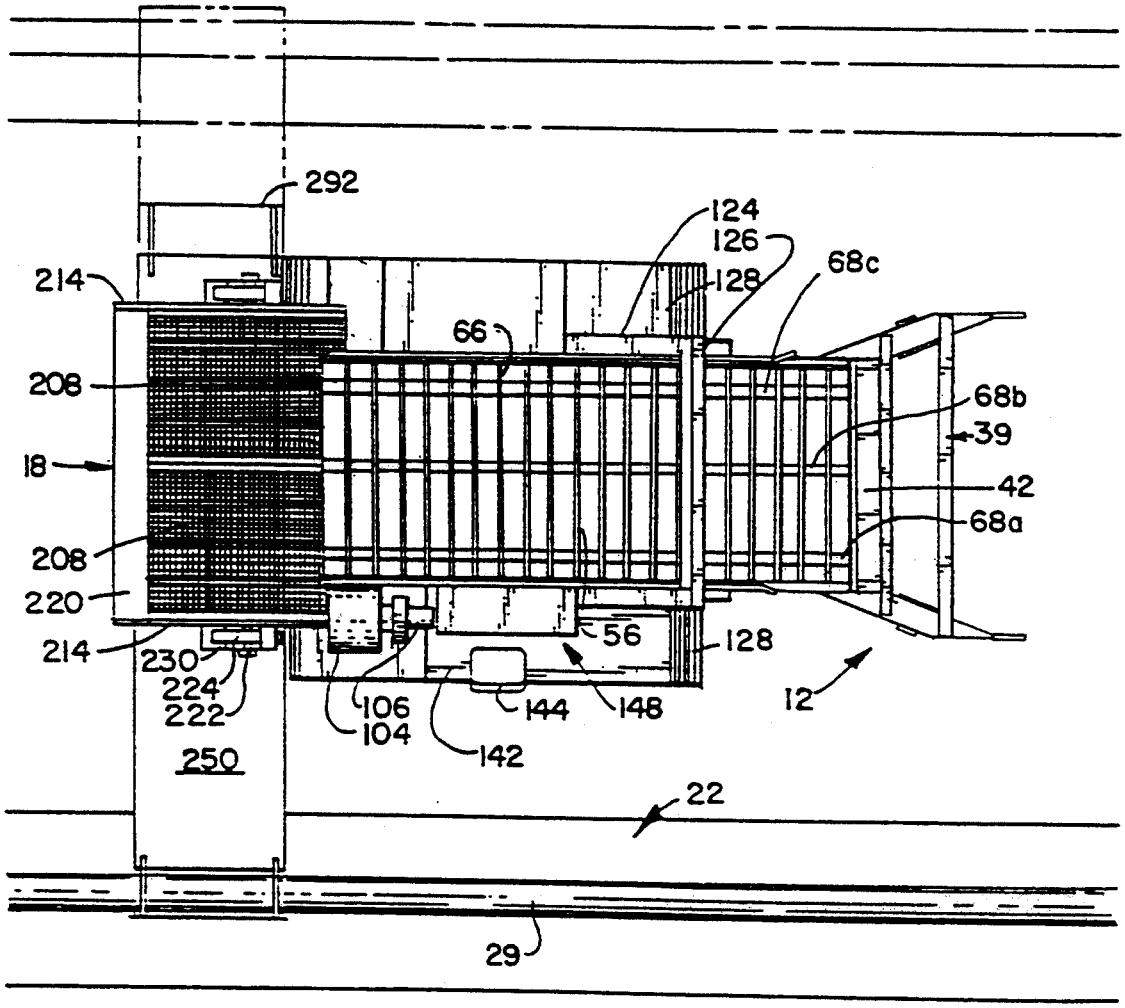
FIG. 5 is a top plan view of the assembly illustrated in FIG. 1.

Referring to FIG. 5, a number of flat members 66 are adapted to be drawn across elevator floor 56 in order to transport spoil in the elevating direction to the separator assembly 18. Flat members 66 are reinforced, and preferably have a height of about 6 inches (15 cm). Flat members 66 are mounted to a right drive chain 68*a*, a center drive chain 68*b*, and a left drive chain 68*c*. Drive chains 68*a*–68*c* are provided to move flat members 66 relative to the elevator floor 56, in order to transport spoil upwardly from spoil guide assembly 12 toward separator assembly 18. A benefit of central chain 68*b* is that it effectively shortens the unsupported length of the flat members 66 between the chains, thus giving flat members 66 greater resistance against bending. This is important, particularly when working in soil that contains a high proportion of large, heavy rocks. In addition, the center chain 68*b* assists in preventing clay and other soil from becoming deposited between the flat members 66 and the elevator floor 56 by keeping the flat members 66 tightly biased against floor 56. As may be seen by referring to FIG. 11 and 19, each of the elevator chains 68*a*–68*c* are formed of a plurality of links 70 as shown for elevator chain 68*c*. Each of the flat members 66 have a spoil engaging surface 76 and a support brace 74 extending along a rear surface to increase the rigidity thereof. Flat members 66 are mounted to the elevator chain 68*c*, for example, by a support bracket 72, which is joined to a flat member 66 by a pair of nut-bolt connectors 78. The elevator chains 68*a*–68*e* are guided in a closed endless path around lower elevator idlers 80*a*–80*c*, (shown in FIG. 19 and sometimes hereinafter collectively referred to by the reference numeral 80) respectively, and a set of upper elevator sprockets, 82 (shown in FIG. 20). In order to provide the proper biasing between idlers 80*a*–80*e* and upper elevator sprockets, a hydro-adjuster assembly 84 is provided for each of the chains 68*a*–68*c*, as is shown in FIG. 2.

Figure 12:
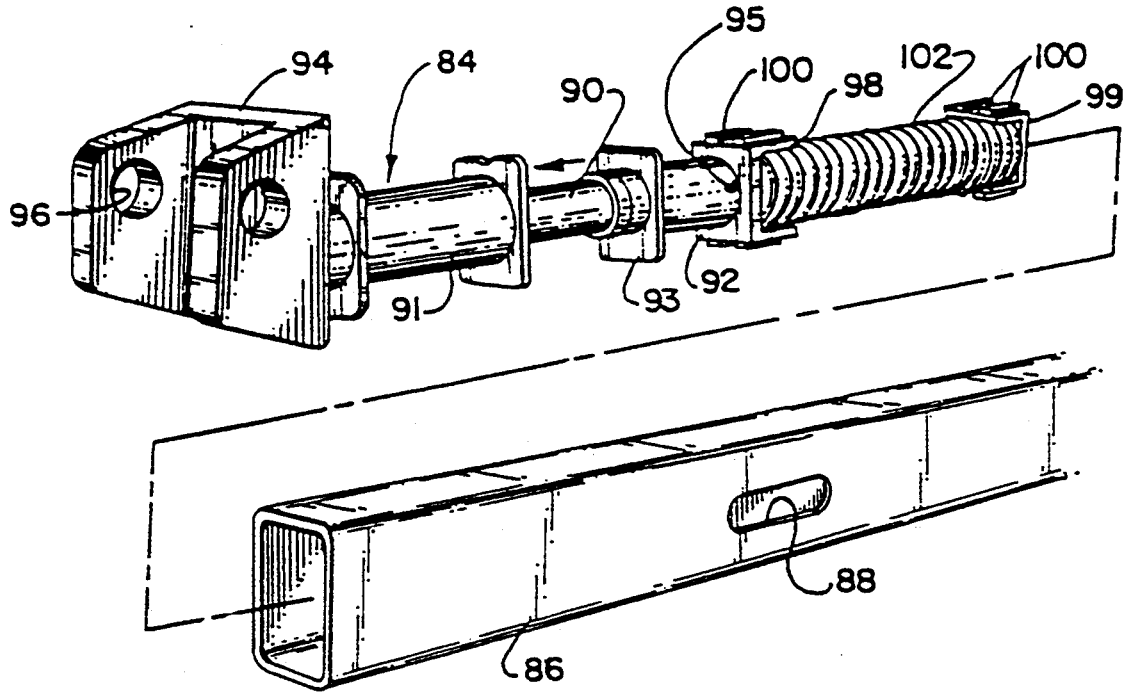
FIG. 12 is an isolated assembly view of a hydro-adjuster mechanism used in the embodiment of FIG. 1.

Referring briefly to FIG. 12, each hydro-adjuster 84 includes a journal bracket 94 having a pair of journal holes 96 defined therein for supporting an axis which supports each of the upper elevator sprockets 82. Journal bracket 94 is resiliently connected to a support member 86, which is integral with an axis supporting the lower elevator sprocket 80 for rotation. Journal bracket 94 has a shaft 91 extending therefrom which terminates in a piston portion 90. Piston portion 90 is slidably received within a cylinder 92 that has an orifice defined therein which may be filled with pressurized grease through an orifice 95. A pair of blocks 98, 99 are mounted on cylinder 92 and are biased apart by a compression spring 102. A number of tabs 100 are provided on outer surfaces of each of the blocks 98, 99. A number of guide plates 93 are provided on shaft 91 to guide the assembly within the interior of support member 86, as is shown in FIG. 12. The block 99 is adapted to contact a stop within support member 86 in order to limit penetration of hydro-adjuster assembly 84 into support member 86. In operation, biasing between sprockets 80 and 82 may be adjusted by introducing or withdrawing pressurized grease through orifice 95. However, if a rock or other large object should become stuck between an elevator chain and one of its support sprockets 80, 82, the hydro-adjuster assembly 84 will deflect by compressing spring 102 so that the additional tension on the chain 68 does not result in catastrophic failure of the entire elevator assembly 16. Referring again to FIG. 1, a hydraulic drive motor 106 is connected to the upper elevator sprockets 82 by an elevator drive transmission 104, which in the preferred embodiment, is of the planetary type.

According to one aspect of the invention, the entire elevator assembly 16, along with the spoil guide assembly 12, pivots about a pivot shaft 122 through a pivotal mounting assembly 120, as is shown in FIG. 2. Pivotal mounting assembly 120 is positioned at the upper end of elevator assembly 16. A pair of elevator lifting assemblies 110 are provided on each side of the elevator assembly 16. Elevator lifting assemblies 110 include cylinders 114 which have pistons 112 received therein. Cylinders 114 are connected to pivot points 116 provided on a frame of vehicle 28, and pistons 112 are connected at pivot points 118 to the side guard portions 108 of the elevator assembly 16. Operation of each of the elevator lifting assemblies 110 is controlled by a central control system, which will be described in detail below.

As is shown best in FIG. 1, a pair of lateral guide posts 124 are provided for giving lateral support to elevator assembly 16 when it is pivoted about mounting assembly 120 by lifting assemblies 110. A cross-bar 126 is provided to give additional rigidity to the guide posts 124 as is illustrated in FIG. 1.

In the illustrated embodiment of the invention, self-propelled vehicle 28 includes a pair of endless track elements 129 having holes 128 defined therein so that mud, snow, or soil does not collect within the track elements 128. Tracks 128 are mounted on rollers 131 of the drawing and provided with conventional guide structure. As used herein, the term "wheel" is used in a broad sense to refer to any ground engaging structure capable of turning about an axle. Each track 128 is driven by a drive sprocket 130 which is driven via a chain from a hydraulic motor output sprocket 132.

As is shown best in FIG. 2, vehicle 28 includes an operator support platform 142 having a battery box 134 and a tool box 136 disposed thereon. A seat 144 is provided on operator platform 142 for supporting an operator. A field tank 138 having a fill spout 140 is provided on an opposite side of platform 142 from the battery box 134 and tool box 136. Adjacent seat 144 is a control panel 148 and a clutch pedal 146, the purpose of which will be described in more detail below.

Figure 10:
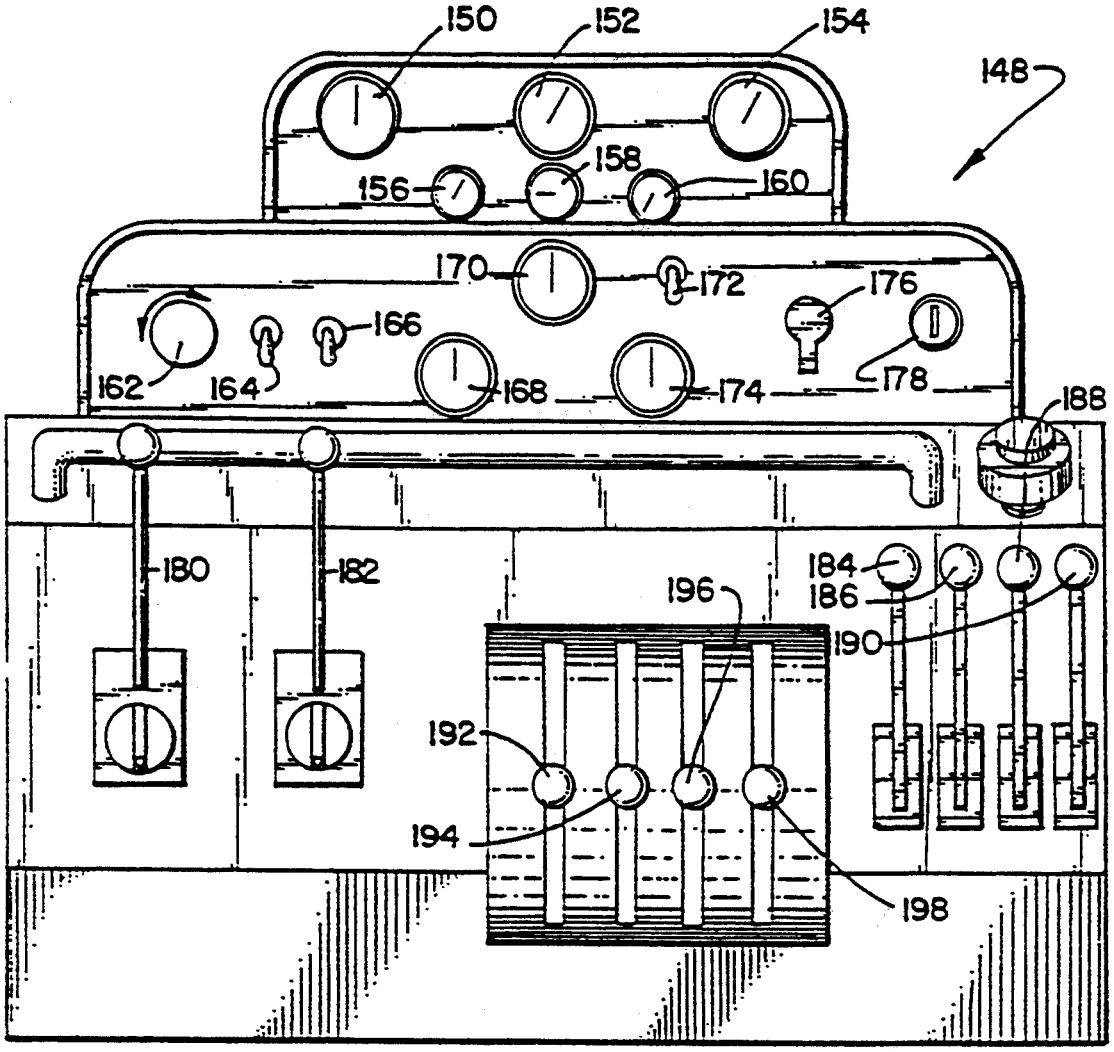
FIG. 10 is an isolated elevation view of a control panel for an apparatus constructed according to the embodiment of FIG. 1.
Figure 11:
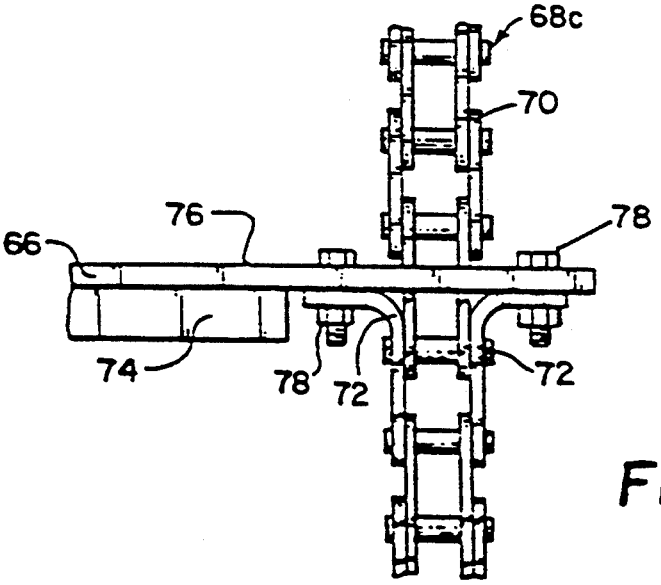
FIG. 11 is an isolated plan view of an elevator chain according to the embodiment of FIG. 1.

Referring to FIG. 10, control panel 148 includes a left track charge pump pressure indicator 150, a right track charge pump pressure indicator 152, and an elevator charge pump pressure indicator 154 on a top portion thereof. Just beneath indicators 150, 152, and 154 is an elevator drive motor gauge 156, a left rotor drive motor pressure gauge 158, and a right rotor drive motor pressure gauge 160. A master light control switch 162 is provided for controlling a number of lamps 200 that are provided about the assembly. A left rotor control switch 164 and a right rotor control switch 166 are provided adjacent light control switch 162. An engine water temperature gauge 168 and an engine oil temperature gauge 170 are mounted adjacent rotor switches 164, 166 along with an engine voltage indicator 174. A track drive high-low speed switch 172 is provided above voltage indicator 174. A starter switch 176 is provided to initiation combustion in the main diesel engine which is provided on the self-propelled tracked vehicle 28, and a master kill switch 178 is provided to cut power throughout the entire pipeline padding assembly 10. On a lower portion of control panel 148 is a shaker speed control lever 180 and conveyor speed control lever 182. To the right of levers 180, 182 is a shaker lift control lever 184, a conveyor shift control lever 186, a conveyor tilt control lever 188, and an elevator lift control lever 190, each having functions which will be described in more detail below.

Mounted in a box beneath the above-mentioned group of control levers is an elevator chain speed control lever 198, and three levers for controlling operation of the track drives for vehicle 28. Specifically, both the left and right tracks 128 of vehicle 28 may be controlled together by a master control lever 192, which is capable of controlling both the direction and the speed of the tracks. Also provided are a left side track travel adjustment lever 194 and a right side track travel adjustment lever 196, each of which is adapted to change the speed or reverse the direction of its respective track relative to the input provided by the master control lever 192, as will be explained in more detail below.

Figure 4:
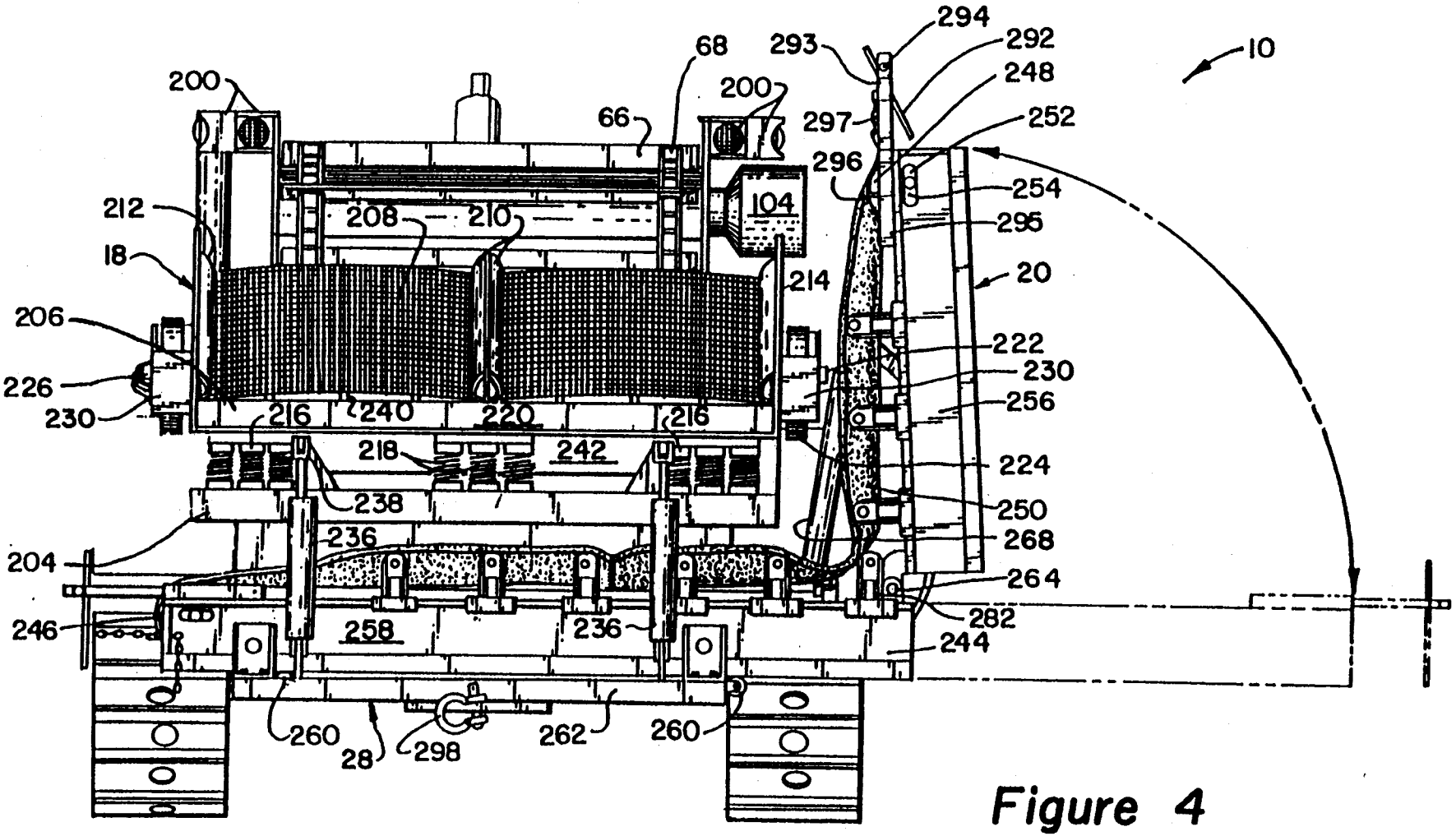
FIG. 4 is a rear elevation view of the pipeline padding assembly of FIG. 1.

Referring now to FIG. 4, separator assembly 18 includes a shaker support frame 204 and a holding frame 206 which has a screen element 208 mounted thereto by a central hold down rib 210 and a number of screen securing brackets 212. The mesh size given screen element 208 is predetermined to the maximum diameter of fine material which is desired to be returned to the excavation atop the coated pipeline. A pair of shaker sideguards 214 are provided on each side of the shaker element 208 to prevent spoil received from elevator assembly 16 from escaping laterally from the separation process.

As is best seen in FIG. 4, holding frame 206 is resiliently mounted with respect to shaker support frame 204 by a plurality of compression springs 218, which are mounted in cup-like compression spring holders 216 provided on both shaker support frame 204 and holding frame 206. A roughs chute 220 is provided on a rear edge of holding frame 206 for guiding the separated rough portion of the spoil rearwardly off the back end of the assembly 10. As may be seen in FIG. 4, a shaft 222 is mounted in bearings which are provided on the holding frame 206, and has a pair of eccentric weights 224 secured for rotation therewith. A hydraulic shaft rotating shaker motor 226 is provided for rotating shaft 222 according to the position shaker speed control lever 180, as will be described in detail below. A guard 230 is provided over each of the eccentric weights 224 to prevent accidental contact with the hands of an operator or the like. In addition, a safety stop arrangement 228 is provided for limiting relative movement between support 204 and holder frame 206, as is shown in FIG. 2. In the preferred embodiment shown in FIG. 2, a tab 232 is mounted on holding frame 206 for reciprocation between a pair of stops on a bracket 207 which is attached to support frame 204.

As may be seen in FIG. 2, the shaker support frame 204 is pivotally mounted with respect to the frame of vehicle 28 at a pivot point 234. A pair of shaker tilt piston-cylinder units 236 are pivotally mounted to the frame of vehicle 28 and to brackets 238 provided on support frame 204 in order to selectively pivot the separator assembly 18 about pivot points 234. As a result, an operator can compensate for differences in surface inclination or spoil consistency that would otherwise effect the operating efficiency of the separating assembly 18. Operation of the shaker tilt piston-cylinder units 236 is controlled through lever 184 on the control panel 148 via a control system, which will be described in detail below.

Referring again to FIG. 4, in order to provide further support for screen element 208 on holding frame 206, a number of support ribs 240 are provided beneath screen element 208 and attached to holding frame 206. In addition, a fines chute 242 is provided beneath holding frame 206 for guiding the fine portion of the spoil to conveyor assembly 20.

Referring to FIG. 4, the structure of conveyor assembly 20 will now be discussed. Conveyor assembly 20 includes a conveyor frame 244 which is mounted for lateral movement relative to vehicle body frame 262 by a plurality of conveyor frame support rollers 260. Conveyor frame 244 is subdivided into a first conveyor portion 256 and a second conveyor portion 258 which is connected to first portion 256 by means of a hinge 264. A first drive drum 246 having a hydraulic motor therein is mounted for rotation on second conveyor portion 258. Likewise, a second drive drum 248 also having a hydraulic motor therein is mounted for rotation on and relative to first conveyor portion 256. Access slots 254 are provided in the first and second conveyor portions 256, 258 for adjusting second and first drive drums 246, 248.

As shown in FIG. 4, an endless conveyor belt 250 is stretched between the first and second drive drums 246, 248. Referring briefly to FIGS. 1 and 2, a piston-cylinder unit 268 is provided for tilting the first conveyor portion 256 relative to second conveyor portion 258. Piston-cylinder unit 268 includes a conveyor tilt piston arm 270 which is pivotally mounted to a projection 274 on first conveyor portion 256 by a pivot point 272. When piston-cylinder unit 268 is caused to contract by the control system, the tint conveyor portion 256 is caused to tilt upwardly with respect to second conveyor portion 258, as is shown in FIG. 4. This position is used when transporting the assembly. When the control system causes piston-cylinder unit 268 to expand, first conveyor portion 256 is lowered so that its axis is substantially collinear with that of second conveyor portion 258, as is shown in phantom lines in FIG. 4. In this latter position, the fine portion of the spoil received from separator assembly 18 may be conveyed atop endless conveyor belt 250 by causing the hydraulic motors within the first and second drive drum 246. 248 to turn the respective drums which is accomplished by the control system.

In order that the pipeline padding assembly 10 of the invention can work on both sides of an excavation, or in both directions on any particular side of an excavation, conveyer frame 244 is made shiftable in a lateral direction so that the conveyor assembly 20 can be extended outwardly over the pipeline to be padded. To this end, a conveyer slide piston-cylinder unit 266 is provided having an actuation arm 276 secured to a projection 280 on conveyer frame 44 by means of a pin 278. When piston-cylinder unit 266 is caused to expand, conveyer frame 244 slides over support rollers 260 to the right, as viewed in FIG. 4. When piston-cylinder unit 266 is caused to contract conveyor frame 244 slides to the left as viewed in FIG. 4. Operation of piston-cylinder unit 266 is controlled via the central control system, as will be discussed in detail below.

Figure 13:
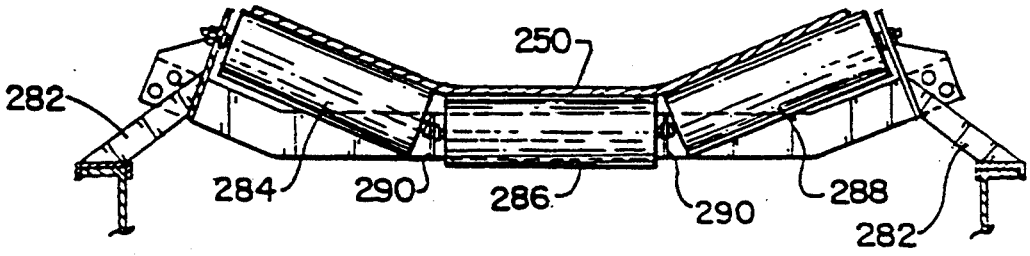
FIG. 13 is a cross-sectional view through a conveyor assembly portion of the embodiment of FIG. 1.

Referring briefly to FIG. 13, an assembly is provided for supporting the top run of the endless conveyor belt 250. A plurality of roller support arms 282 and a corresponding number of central support brackets 290 support for rotation a corresponding number of rear belt guide rollers 284, central belt guide rollers 286, and front guide rollers 288. As shown in FIG. 13, the rear and front belt guide rollers 284, 288 are inclined so as to center the fine portion of the spoil received from separator assembly 18 on endless belt 250. The provision of rollers 284, 286, 288 allow conveyor assembly 20 to operate at a higher capacity than would otherwise be possible.

Referring again to FIGS. 1 and 4, a deflector plate 292 is pivotally mounted on a pair of extension arms 293 which are adjustably arranged to extend from support sleeves 295 on the conveyor frame 244. Deflector plate 292 is provided to deflect the fine material thrown off the conveyor belt 250 downward into the excavation on top of the pipeline to be padded. In order to limit pivoting of deflector plate 292 relative to the extension arms 293, a chain 297 can be secured to deflector plate 292 and adjustably fastened within a keyhole mount 299 on the conveyor frame 244, as is shown in FIG. 1. Adjustment studs 296 may be provided in the support sleeves 295 to bear down upon extension arms 293 when tightened, thereby locking the extension arms in position relative to conveyor 244. When the first conveyor portion 256 is caused to fold up into a transportation position, as shown in FIG. 4, the deflector plate 292 will pivot to a position substantially parallel to the extension arms 293 and support sleeves 295 so as to maximize clearance when loading the assembly 10 onto a trailer or into a storage location.

As shown in FIG. 4, a tow hook 298 is provided on a rear surface vehicle body frame 262. Tow hook 298 can be used to tow assembly 10 during loading or in the event of breakdown in the self-propelled tracked vehicle 28. Alternatively, tow hook 298 can be used to tow a trailer therebehind in order to collect the rough portions of the spoil which are directed behind the assembly 10 by roughs chute 220.

The control system for operating the various elements of the pipeline padding assembly 10 will now be described. As may be seen in FIGS. 1–3, one feature of pipeline padding apparatus 10 is that the engine section 300 of support vehicle 28 is positioned by support structure 39 in a location which is elevated with respect to and forward of a front end of the elevator section 16. Due to its location, engine section 300 applies a downward force to the spoil guide assembly 12 during operation, which tends to stabilize the spoil guide assembly 12 relative to the spoil 24. By placing engine section 300 above and forward of elevator section 16, the amount of dust and dirt that engine section 300 will be exposed to during operation of the apparatus 10 is greatly reduced.

Furthermore, as shown in FIGS. 3 and 19, the engine 300 is preferably positioned offset from the center line 33 so that the operator stationed at platform 142 can have a better field of view to the front of the assembly 10.

Referring to FIG. 2, since hydraulic pressure lines 301 have to reach a relatively long distance from the position of engine section 300 to their respective motors and piston-cylinder units, a greater amount of surface area is exposed, which promotes cooling of the hydraulic fluid or oil therein. In order to enhance this cooling effect, hydraulic pressure lines 301 are positioned externally of vehicle 28 to the greatest extent possible.

Referring now to FIG. 19, the engine support structure 39 includes a first cross beam 39*a* which is elevated with respect to the first and second guide projections 30, 32 by a pair of angle posts 39*b*. A second cross beam 39*c* is positioned horizontally above the first and second guide projections 30, 32 by a second pair of angle posts 39*d*. Engine section 300 rests upon the top surfaces of the first and second cross beams 39*a* and 39*c*, as is best shown in FIGS. 3 and 6.

Referring to FIG. 6, in order to provide access to engine section 300, a number of steps 40 are attached to an outer surface of each of the first and second guide projections 30, 32.

FIG. 15 is a schematic depiction of a mechanical drive train for the various mechanical pumps used in the preferred embodiment of the invention. As shown in FIG. 15, a diesel engine 300 is adapted to power a master pump drive transmission 304 via a master clutch 302 which is controlled by clutch pedal 146 at the control panel 148. Thus, an operator can disengage all of the hydraulic pumps at a given time merely by depressing the master clutch pedal 146.

Master pump drive 304 is mechanically connected to an elevator drive hydraulic pump 306, a left track drive hydraulic pump 308, and a right track drive hydraulic pump 312. Master pump drive 304 is further connected to a conveyor drive hydraulic pump 310 via a two-speed transmission 311 which is shiftable between a high-speed mode and low-speed mode responsive to the high-low switch 172 on control panel 148. The shifting of transmission 311 between the high-speed and low-speed modes is effected via a solenoid-type arrangement in a manner that is known to the mechanical arts.

Also adapted to be driven by master pump drive 304 is a stack hydraulic pump assembly 314 including a hydraulic pump 316 for driving the shaft 222 and eccentric weights 224 in separator assembly 18, a hydraulic pump 318 for driving the hydraulic motor 58 for the right rotary feeder assembly 13, a hydraulic pump 320 for driving the hydraulic motor 58 for the left rotor assembly 14, and a combined function pump 366 which provides pressure for operating the conveyor tilt mechanism, the separator lift mechanism, the elevator lift mechanism, and the mechanism for laterally shifting the conveyor, all of which will be described in detail below.

Figure 14A:
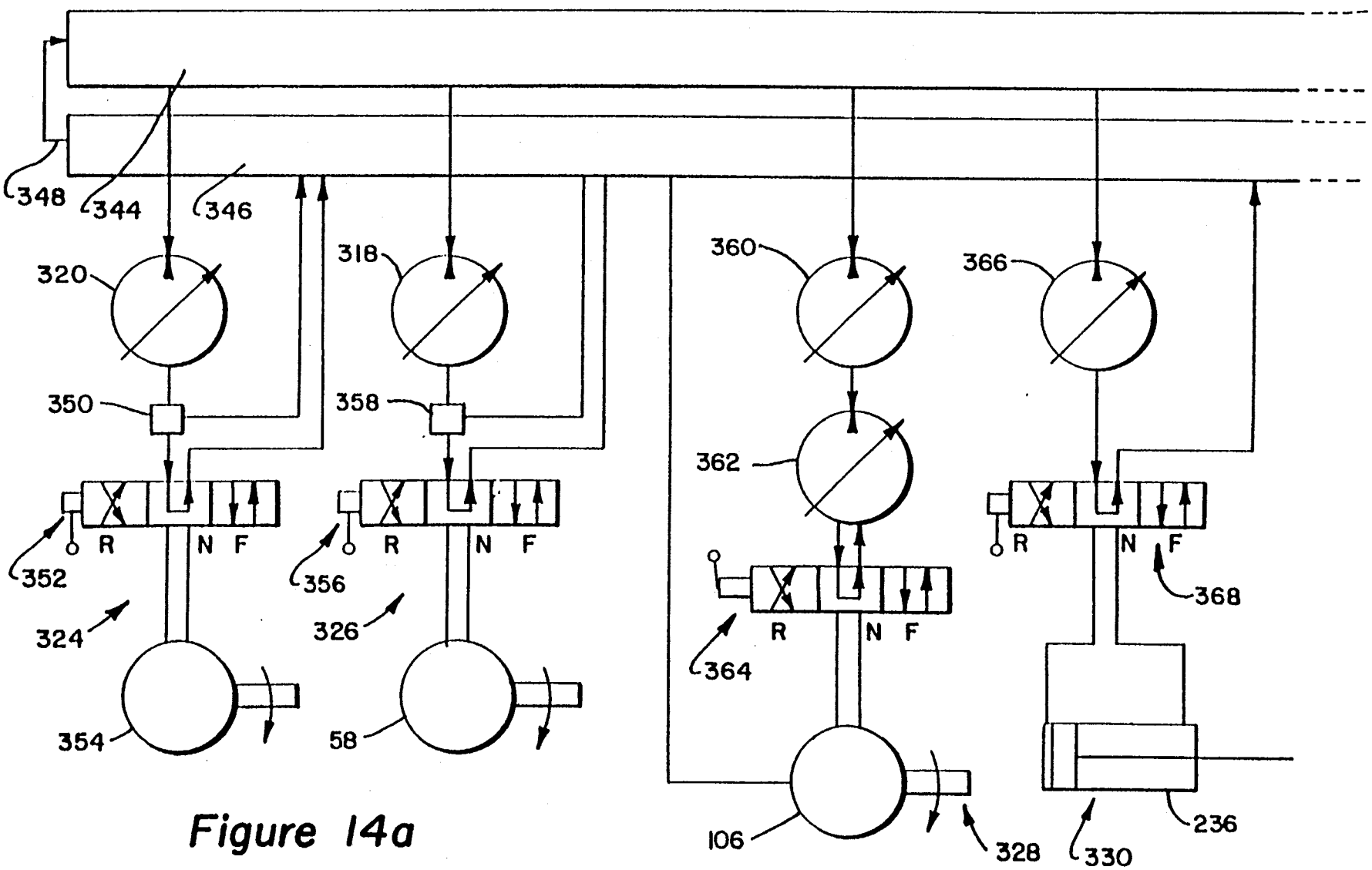
FIGS. 14*a*–14*c* are a schematic depiction of the control system used in the embodiment of FIG. 1.
Figure 14B:
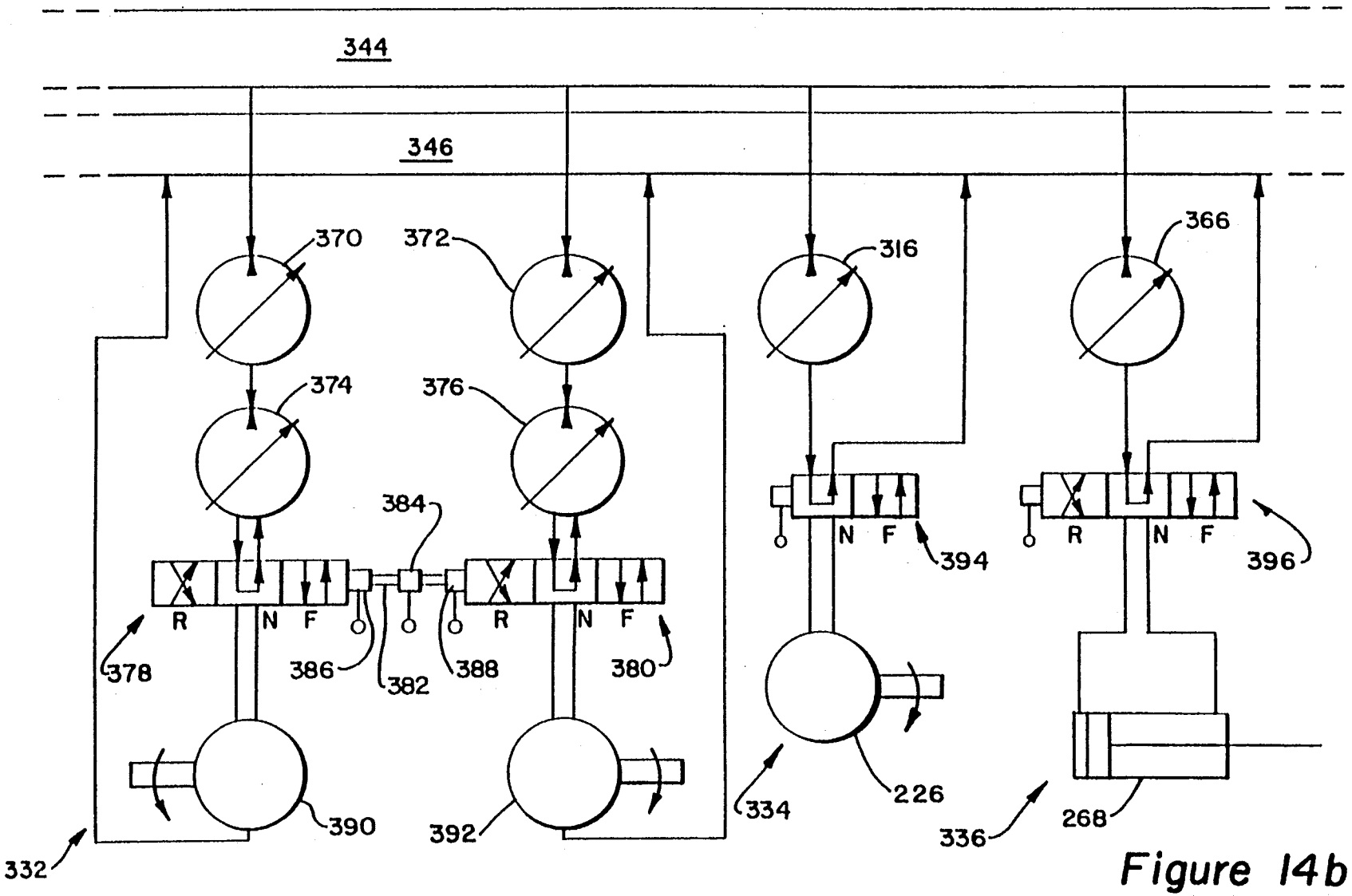
Figure 14C:
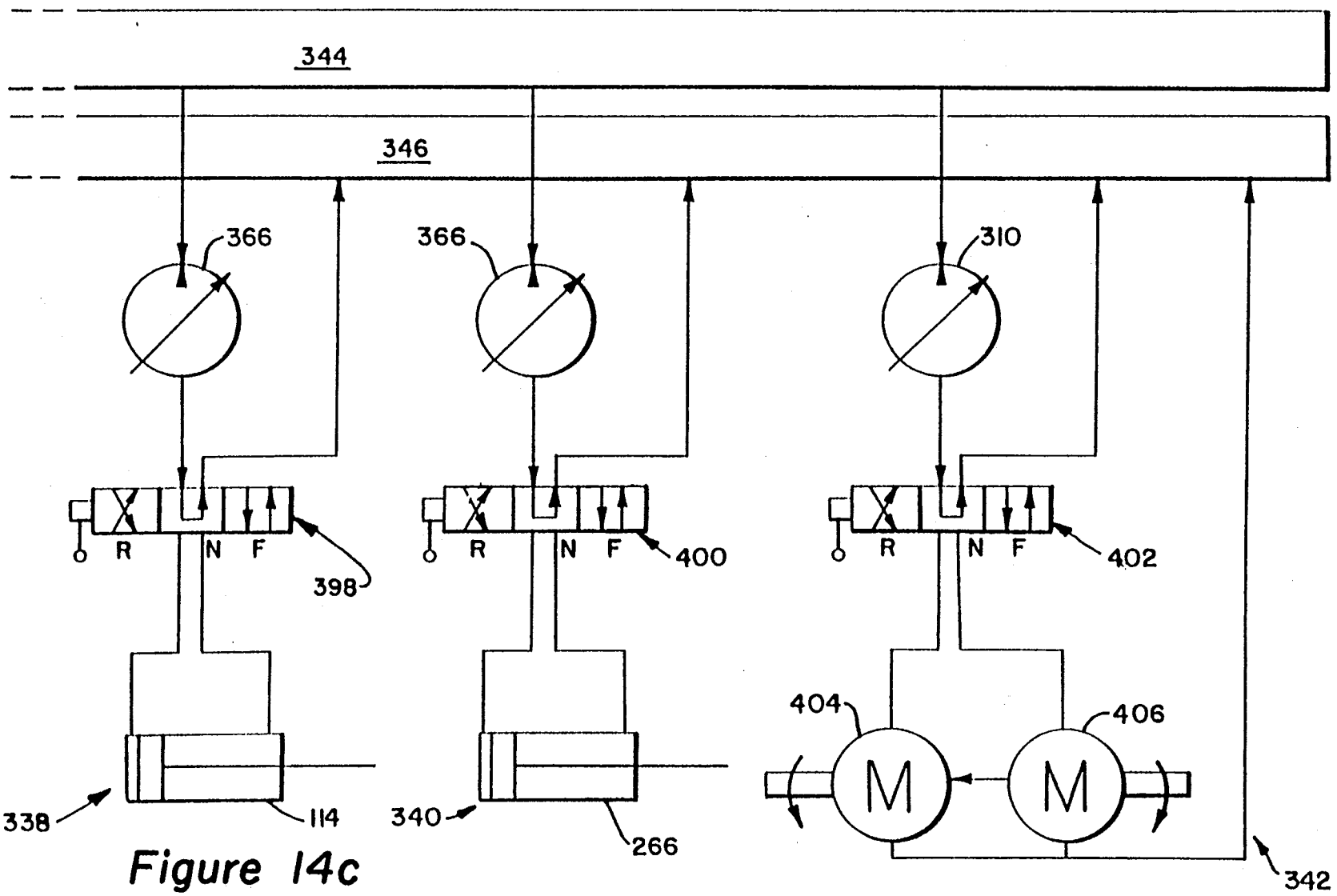

Referring now to FIGS. 14*a*–14*c*, the hydraulic control system for assembly 10 includes a hydraulic oil storage tank 344 and a hydraulic oil cooler 346 which returns oil to tank 344 via a tank return line 348. Referring first to FIG. 14*a*, a left rotor control circuit 324 is provided for controlling the left rotary feeder assembly 14. In circuit 324, hydraulic pump 320 supplies hydraulic oil to rotate the left rotor hydraulic motor 58 (which is represented in FIG. 14*a* as left motor 354) in the reverse direction when the left rotor control valve 352 is in the "R" position. When valve 352 is in the "N" position, pump 320 simply draws hydraulic oil from tank 344 and returns it to oil cooler 346. When valve 352 is in the "F" position, pump 320 supplies hydraulic oil from tank 344 to left rotor hydraulic motor 354 in a direction opposite that supplied when valve 352 is in the "R" position, thereby driving left rotor hydraulic motor 58, in a forward rotary direction. As is shown FIG. 14*a*, a pressure relief valve 350 is interposed between left rotor pump 320 and control valve 352. Should and excessive level of pressure build up in the supply lines to motor 354, as may occur when a large rock is caught on the rotor element 51, pressure relief valve 350 will allow hydraulic oil to return to tank 344 via the hydraulic oil cooler 346. Control valve 352 is of the variable capacity type so that an operator can control the speed as well as the direction of the motor 354.

The right rotor control circuit 326 operates in a similar manner. When right rotor variable capacity control valve 356 is in the "R" position or "F" position, hydraulic oil is supplied to right rotor hydraulic motor 58 by the right rotor hydraulic supply pump 318 from the tank 344 in order to drive hydraulic motor 58 in the desired direction. When right rotor control valve 356 is in the "N" position, oil is simply recirculated back into tank 344 through the hydraulic oil cooler 346. Should excessive pressure build up within the circuit, pressure relief valve 358 allows oil to escape back into hydraulic oil cooler 346. The right rotor control valve 356 is operated via a linkage from switch 166 on the control panel 148 and left rotor control valve 352 is likewise operated via a linkage by switch 164 on the control panel 148.

A hydraulic elevator control circuit 328 includes a hydraulic pump 362 which is arranged in a closed relationship relative to an elevator drive motor 106 via an elevator control valve 364 which is shiftable between an "R" position in which hydraulic oil is delivered to motor 106 in a first direction, and in an "N" position in which hydraulic oil is merely circulated within pump 362, and in an "F" position in which hydraulic oil is supplied to motor 106 in a second direction opposite the first direction. As shown in FIG. 14*a*, motor 106 is provided with a case drain which dumps into hydraulic oil cooler 346. In order to replenish in circuit 328, which is lost through the case drain, a charge pump 360 is provided for drawing oil out of tank 344 and supplying the oil to hydraulic pump 362. The elevator control valve 364 is of the variable capacity type, which allows an operator to control not only the direction of motor 106 but also its speed. Control valve 364 is operated via lever 198 on the control panel 148.

As is shown in FIG. 14*a*, a separator lift control circuit 330 includes the combined function pump 366 which supplies hydraulic fluid to a pair of lift piston-cylinder units 236, which are represented by a single cylinder in FIG. 14*a* for schematic purposes only. A shaker lift control valve 368 is interposed between the combined function pump 366 and piston-cylinder units 236, and is shiftable via a linkage control by lever 184 on control panel 148 between position "R", position "N", and position "F". When in position "R", piston-cylinder units 236 are caused to contract. When in position "F", piston-cylinder units 236 are caused to expand. When in position "N", piston-cylinder units 236 remain locked in whatever position they might have been in when valve 368 was shifted to the "N" position. It is not essential that valve 368 be of the variable capacity type, but it can be so designed for the convenience of the operator.

Referring now to FIG. 14*b*, a track drive control circuit 332 includes a left track hydraulic pump 374 which is arranged in close relationship relative to a left track hydraulic drive motor 390 via a left control valve 378, and a right track hydraulic pump 376 which is similarly arranged in close relationship with right track hydraulic drive motor 392 via a right control valve 380. Both the left and right control valves 378, 380 are shiftable between "N", and "F" positions, and are joined together via a linkage 382. A master track control actuator 384 is provided for shifting linkage 382 so that the left and right control valves 378, 380 act in concert. Master track control actuator 384 operates in response to the position of the master control lever 192 which is provided on control panel 148. Both the left and right control valves 378 and 380 are of the variable capacity type, which allows the operator to control the speed of motors 390, 392 as well as their direction with the single master control lever 192. A left track adjustment actuator 386 is connected between linkage 382 and left control valve 378. Similarly, a right track adjustment actuator 388 is connected between the linkage 382 and right control valve 380. Left track adjustment actuator 386 is controlled via a linkage by the left side track travel adjustment lever 194 on control panel 148. Likewise, the right track adjustment actuator 388 is controlled via a similar linkage by the right side track travel adjustment lever 196.

When adjustment actuators 386, 388 are in a neutral position, corresponding to the position of levers 194, 196 as shown in FIG. 10, the left and right control valves 378, 380 are aligned so that the left and right track drive motors 390, 392 operate in concert responsive to the position of the master control lever 192 on control panel 148. For example, if lever 192 is in the position indicated in FIG. 10, both control valves 378, 380 are in the "N" position, and neither of the motors 390, 392 are being driven. If control lever 192 is pushed upwardly, both control valves 378, 380 slide into the "F" position and motors 390, 392 are driven in a forward direction at the same speed. Since the valves 378, 380 are of the variable capacity type, the forward speed of motors 390, 392 depends on how far the operator chooses to push lever 192 in the upward direction. If the operator pulls lever 192 downwardly, both valves 378, 380 slide to the "R" position, thereby driving both track drive motors 390, 392 in reverse.

When it is desired to move track motors 390, 392 at different speeds, such as is necessary when mining assembly 10, levers 194 and 196 are used to vary the relative positions of the left and right control valves 378, 380. In this way, a slight deviation in the speed of the tracks may be compensated for by shifting one of the levers 194, 196 a slight amount. By shifting one of the levers 194, 196 all the way up or all the way down, one of the motors 390, 392 may be driven in a direction opposite from the other, which results in sharp turning of the assembly. As a result, levers 192, 194, and 196 may be used to conveniently control the locomotion of assembly 10.

As is shown in FIG. 14*b*, each of the left and fight track drive motors 390, 392 are provided with case drains which lead back to oil cooler 346. In order to compensate for oil lost through the case drains, a left charge pump 370 is provided for charging left track pump 374 with oil, and a right charge pump 372 is provided for similarly charging right track pump 376 with oil.

In order to drive the shaker portion of separator assembly 18, a shaker drive circuit 334 includes a hydraulic pump 316 which draws oil out of tank 344 and supplies it to a shaker motor 226 via a two-way valve 394. Shaker control valve 394 is shiftable between an "N" position and an "F" position. In the "N" position, oil is merely recirculated back into tank 344 via the hydraulic oil cooler 346. When in the "F" position, valve 394 supplies oil to motor 226 in order to drive the shaft 222 and eccentric weight 224, as is described above. Shaker control valve 394 operates in response to the position of lever 180 on control panel 148 and is of the variable capacity type, so the operator can control the speed of the rotation of the shaker motor 226.

A conveyor lift circuit 336 includes a conveyor piston-cylinder unit 268 that is connected to the combined function pump 366 via a control valve 396, which is shiftable between an "R" position, "N" position, and "F" position. When valve 396 is in the "R" position, piston-cylinder unit 268 will be retracted. When valve 396 is in the "F" position, piston-cylinder unit 268 will be extended. When valve 396 is moved to the "N" position, piston-cylinder unit 368 will be frozen in whatever position it might have been in at the time. Valve 396 may be one of the variable displacement type for the convenience of the operator, and is driven via a linkage by lever 188 on control panel 148.

Referring now to FIG. 14c, an elevator lift circuit 338 includes a pair of elevator lift cylinders 114 which are connected to combined function pump 366 via an elevator lift control valve 398 which is positionable responsive to lever 190 on control panel 148. When valve 398 is in the "R" position, cylinders 114 are caused to retract. When valve 398 is in the "F" position, cylinders 114 are caused to extend. When valve 398 is shifted to the "N" position, cylinders 114 are frozen in whatever position they might have been in at that time.

A conveyor lateral shift circuit 340 for laterally shifting the conveyor includes conveyor shift cylinder-cylinder units 266 which are connected to the combined function pump 366 via a conveyor shift valve 400 which operates in response to the position of control lever 186 on control panel 148. When in the "R" position, piston-cylinder unit 266 contract; they expand when in the "F" position. The "N" position freezes piston-cylinder units 266 in whatever position they might have been in at the time.

A conveyor motor drive circuit 342 includes a tint conveyor motor 404 and a second conveyor motor 406 which is connected in series with motor 404 so that both operate in concert in response to hydraulic fluid supplied by a conveyor drive hydraulic pump 310. Interposed between pump 310 and the motors 404, 406 is conveyor control valve 402 which operates in response to control lever 182 on the control panel 148. Control valve 402 is of the variable capacity type, so that the speed as well as the direction of motors 404, 406 can be controlled by the operator. A case drain is provided to convey oil leakage within the motors 404, 406 back to the hydraulic oil tank 344 via oil cooler 346. As was previously discussed, first and second conveyor motors 404, 406 are positioned within the first drive drum 246 and second drive drum 248.

The various modes of operation of a pipeline padding assembly constructed according to the preferred embodiment of the invention will now be discussed. Referring to FIGS. 1 and 2, the pipeline padding assembly 10 is shown operating in a pile of spoil on relatively level ground. In this mode of operation, both the elevator lift assemblies 110 and the separator lift piston-cylinders units 236 are in an intermediate position so that the lower surfaces 41 of the guide projections 30, 32 are in contact with the underlying ground surface, and the separator assembly is inclined at the proper degree to allow only the rough portion of the spoil to fall off the rear end thereof.

Figure 16:
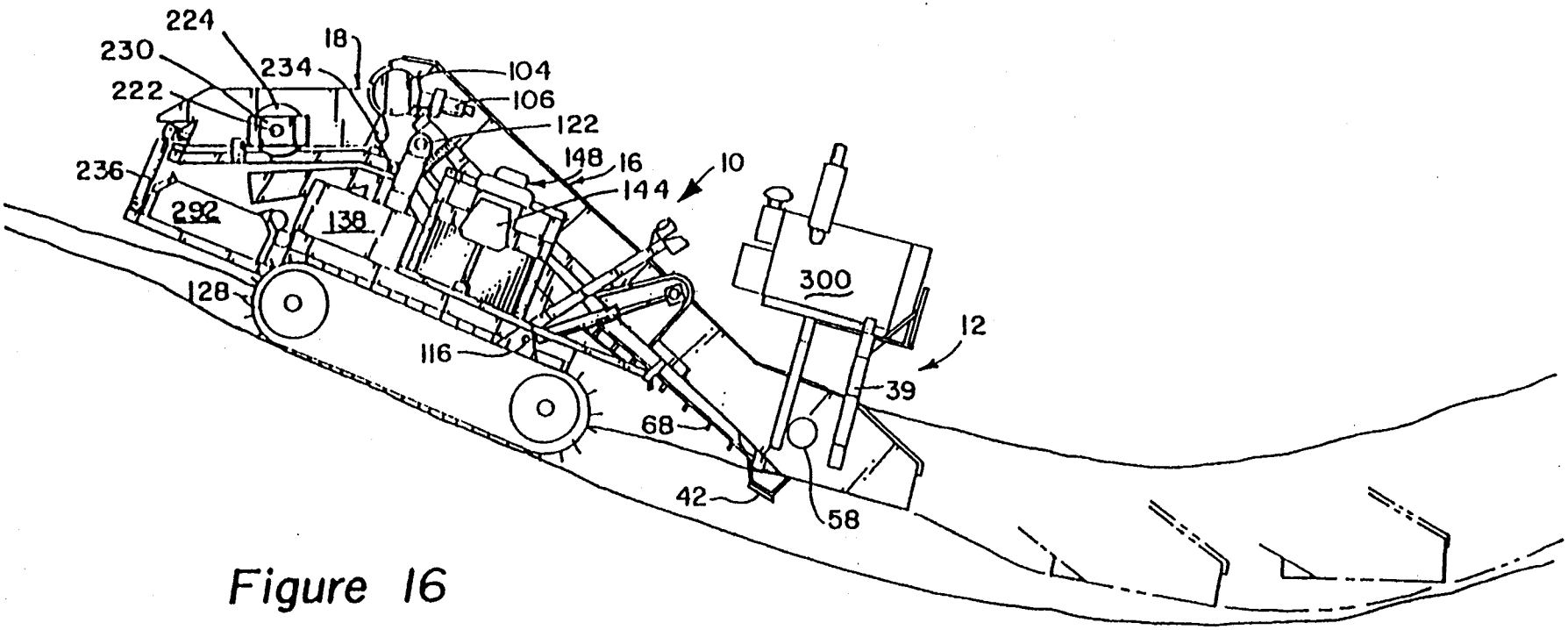
FIG. 16 is a diagrammatic view illustrating the operation of an assembly according to the embodiment of FIG. 1 in a second operating position.

FIG. 16 illustrates the assembly 10 in a second operating position, wherein the pipeline padding assembly 10 is entering a sharply inclined ditch or hollow. In this instance, the elevator assembly 16 is caused to pivot to an upward position, so that underlying soil is not scraped into the elevator along with the spoil. In addition, the separator tilt piston-cylinder units 236 are contracted so as to maintain the separator screen element 208 at its proper inclination.

Figure 17:
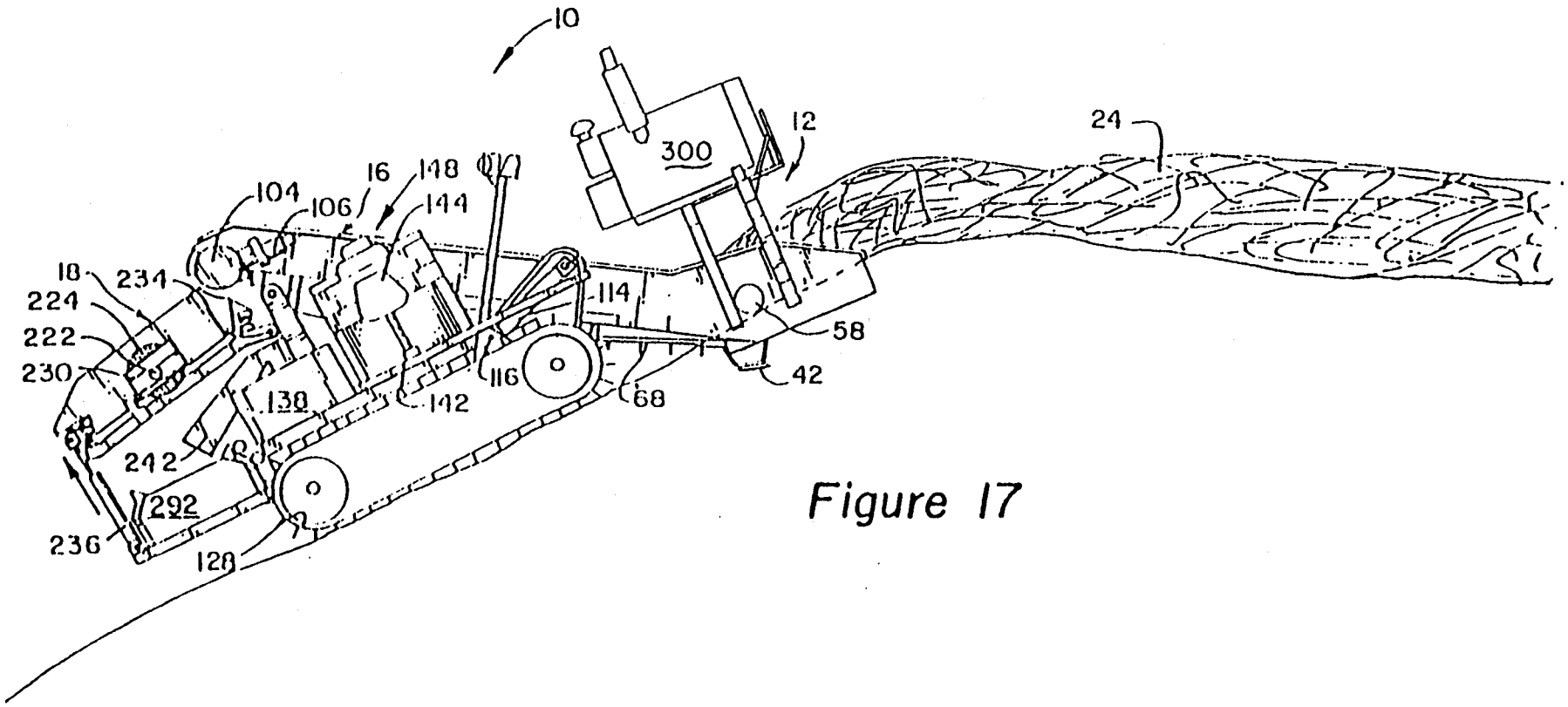
FIG. 17 is a diagrammatical view illustrating the operation of an assembly according to the embodiment of FIG. 1 in a third operating position.

FIG. 17 illustrates the pipeline padding assembly 10 in a third operating mode, in which the assembly is coming up a steep incline. In this case, the elevator assembly 16 is pivoted to a lower position so as to keep the lower surfaces of guide projections 30, 32 at a constant depth in the pile of spoil 24. Furthermore, as shown in FIG. 17, the elevator assembly 16 can be pivoted to a sufficiently low position so as to keep the lower guide surfaces of guide projections 30, 32 at a constant depth below the underlying surface even when the vehicle is coming up a steep incline, whereby as much spoil as possible will be scooped into the elevator assembly 16. In addition, the separator tilt piston-cylinder units 236 are extended so as to maintain the separator screen element 208 at its proper inclination. Thus, as shown in FIG. 16 and 17, the assembly 10 can be used to collect spoil excavated from the pipeline trough or it can be used to collect in situ spoil below the ground surface.

As vehicle 28 moves forward, the operator adjusts the level of cutter element 42 relative to the ground by pivoting elevator assembly 16 with respect to vehicle 28. In most conditions, cutter element 42 should ride within the pile of excavated spoil 24, not in the underlying ground. If the operator finds that conveyor assembly 20 is not providing enough fine material 26 to properly pad the pipeline, the level of cutter element 42 is lowered. In extreme circumstances, cutter element 42 can be lowered sufficiently enough to cut into the underlying ground to collect in situ spoil. In these situations, the downward force provided by engine section 300 helps cutter element 42 maintain its lowered position. As can be seen in FIG. 17, the apparatus can process the native ground or earth materials to obtain fine material for padding a pipeline trough. During normal operating conditions, the presence of engine section 300 helps dampen vibration of spoil guide assembly 12, and contributes to the overall stability of vehicle 28. Rocks and other hard objects are intercepted and deflected upwardly by cutter element 42 to elevator assembly 16, so that damage to the underside of vehicle 28 is prevented.

As may be seen in FIG. 18, the cross section of spoil which is engaged by cutter element 42 is leveled out to a plane 55. It will be seen that spoil which passes beneath the bottom surfaces or edges 41 of guide projections 30, 32 is leveled into smoothed out paths 50. FIG. 19 provides a diagrammatical plan view of the smoothed out paths 50. As may be seen in FIG. 19, paths 50 are deliberately aligned with the left and right vehicle tracks 128 on support vehicle 28. As a result, spoil guide assembly 12 creates a level path upon which tracks 128 can ride, which further contributes to the smoothness and stability of the pipeline padding assembly 10 during operation.

THE EMBODIMENT OF FIG. 20

Figure 20:
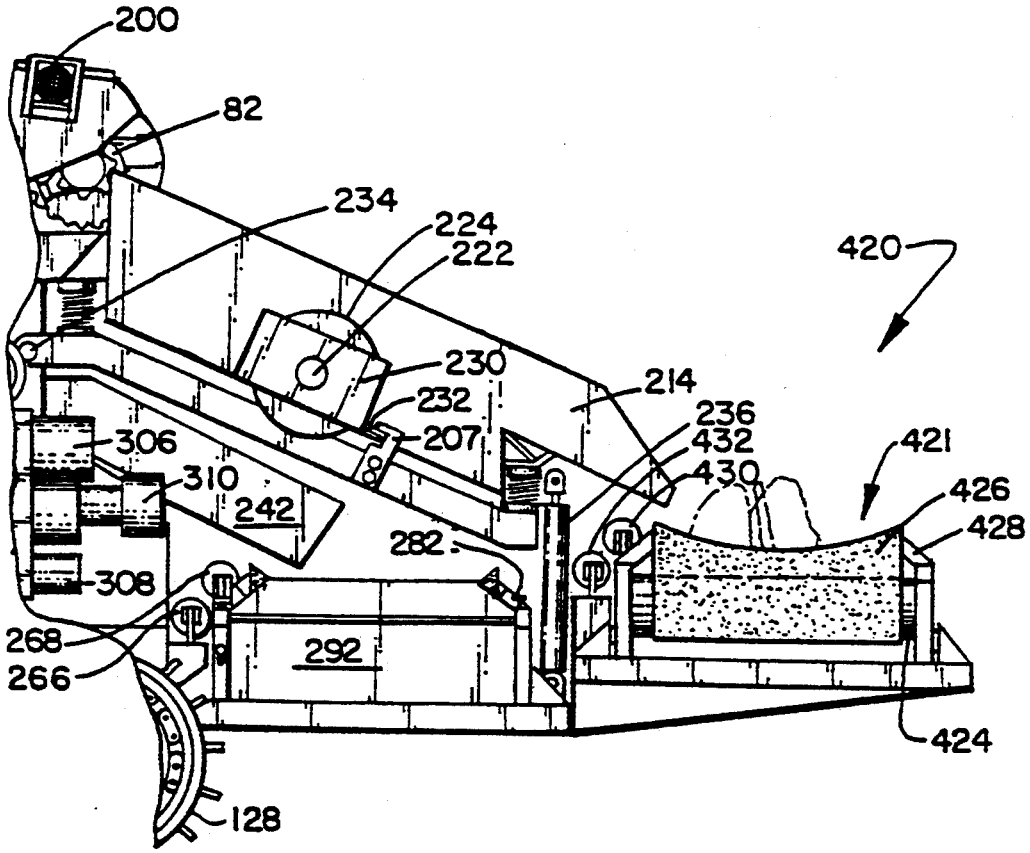
FIG. 20 illustrates an alternative embodiment of one feature of the invention.

Referring now to FIG. 20, an alternative embodiment 420 of the pipeline padding assembly 10 is disclosed wherein the rough portion of the spoil which spills off the roughs chute 220 is guided into a nearby vehicle, such as a dump truck, or to the side of the padding assembly away from the excavation having the pipeline therein. Second conveyor assembly 421 is constructed similarly to conveyor assembly 20 in that it is both laterally shiftable via a piston-cylinder unit 432 and has first and second portions which tilt relative to each other for storage responsive to a tilt piston-cylinder unit 430. A number of roller guide brackets 428 are provided for supporting a number of belt guide rollers beneath an endless conveyor belt 426, as in the conveyor assembly 20. A pair of drive drum 424 are provided for driving endless conveyor belt 426. The side piston-cylinder unit 432, the tilt piston-cylinder unit 430, and the hydraulic motors for turning drums 424 would all be controlled via the control circuit by additional circuits similar to those used to control the corresponding components of conveyer assembly 20. In this way, the large rocks and other rough portions of the spoil could be collected to be used as fill or masonry or for other applications.

THE EMBODIMENT OF FIGS. 21–22

Figure 21:
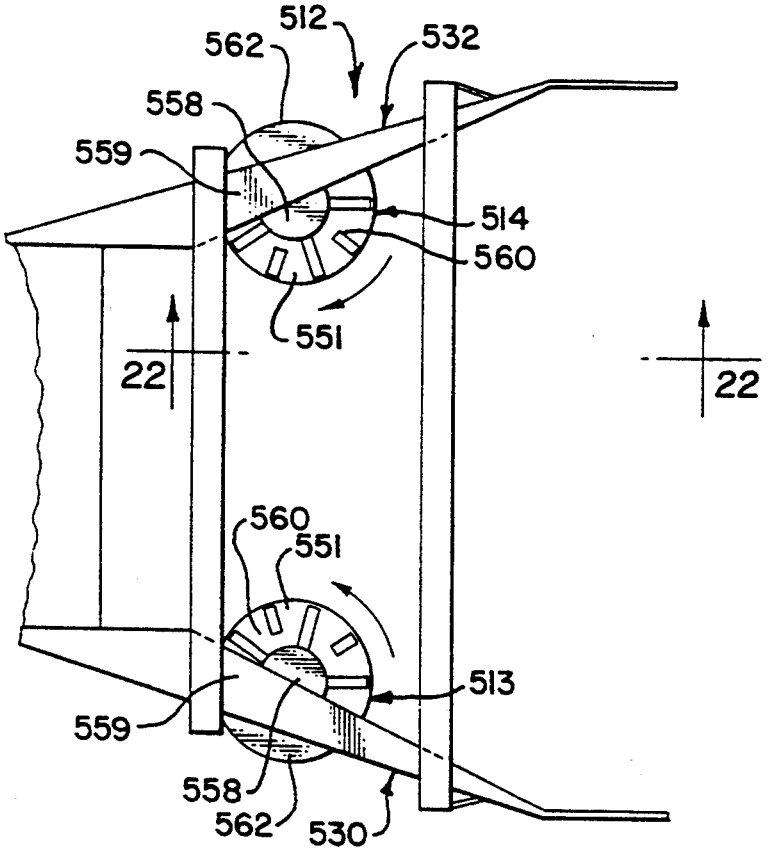
FIG. 21 is a top section view of a second embodiment of the pipeline padding apparatus shown in FIG. 1 wherein the rotary feeders are mounted horizontally.
Figure 22:
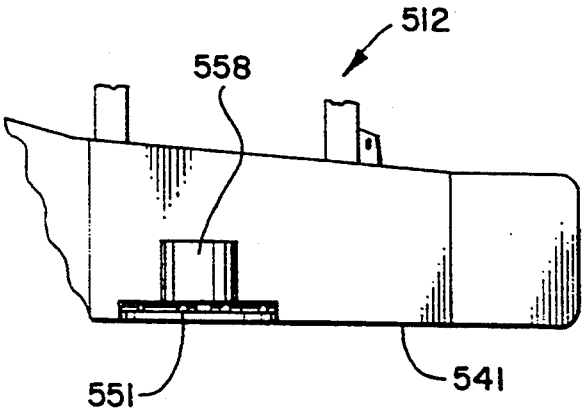
FIG. 22 is a side elevation view taken along lines 22—22 of FIG. 21.

FIGS. 21–22 illustrate a second embodiment of a spoil guide for a padding assembly 10. In the alternative embodiment shown in FIGS. 21–22 for the spoil guide 512, a right rotary feeder assembly 513 and a left rotary feeder assembly 514 are mounted horizontally in the spoil guide projections 530, 532, respectively. Each of the right and left rotary feeder assemblies 513, 514 include a rotor element 551, which is similar to the rotor element 51 described above. As best shown in FIG. 21, the rotary feeder assemblies 513, 514 are mounted so that a portion 560 of the rotor element 551 is inwardly exposed to engage the spoil at or beneath the bottom edge 541 of guide projections 530, 532. As shown in FIG. 21, the portion of the feeder assemblies 513, 514 that extends outwardly of spoil guide projections 530, 532 is protected by a cowling 562. Right and left rotary feeder assemblies 513, 514 are provided with a similar motor and drive arrangement as discussed for the embodiment of FIGS. 1–19, and a control system is provided for controlling operation of both of these motors. The hydraulic lines to the hydraulic motors 558 can be designed to pass through the top wall 559 of the spoil guide projections 530, 532. In operation, right and left rotary feeder assemblies 513, 514 assist in directing spoil from spoil guide assembly 512 toward the center of elevator assembly 16.

THE EMBODIMENT OF FIG. 23

Figure 23:
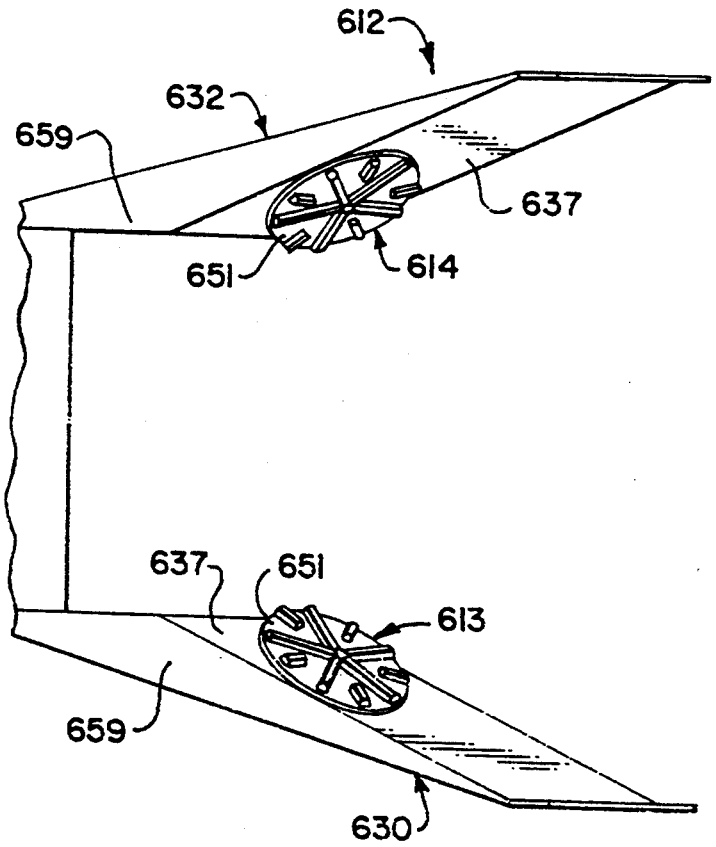
FIG. 23 is a top plan view of a third embodiment of the pipeline padding apparatus shown in FIG. 1 wherein the rotary feeders are mounted at an angle to the vertical.

FIG. 23 is a top plan view of a third embodiment of a spoil guide 612 for a padding assembly 10. In the alternative embodiment shown in FIG. 23 for the spoil guide 612, the guide projections 630, 632 have inner surfaces 637 are obliquely oriented toward the elevator assembly 16 to deflect spoil both inwardly toward the center of elevator assembly 16 and also upwardly toward the forward end of the elevator assembly 16. A right rotary feeder assembly 613 and a left rotary feeder assembly 614 are mounted in the spoil guide projections 630, 632. Each of the fight and left rotary feeder assemblies 613, 614 include a rotor element 651. The rotor element 651 includes a base plate portion and a plurality of radially oriented raised paddles for engaging and moving spoil, similar to rotor element 51 previously described. The rotor element 651 is mounted to the first guide surface portions 637 of the spoil guide assembly 612. The rotor element 651 is mounted so that the base plate portion is slightly raised from the surface of the first guide surface portions 637. The angle of the inner surfaces 637 can be adjusted during manufacturing of the spoil guide assembly 612 to achieve good material movement. Right and left rotary feeder assemblies 613,614 are provided with a similar motor and drive arrangement as discussed for the rotary feeder assemblies of the embodiment shown in FIGS. 1–19, and a control system is provided for controlling operation of both of these motors. In operation, right and left rotary feeder assemblies 613, 614 assist in directing spoil from spoil guide assembly 612 toward the center of elevator assembly 16.

It is to be understood, however, that even through numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

Having described the invention, what is claimed is:

1. An apparatus for padding pipe laying in an excavated ditch where the spoil from the excavated ditch is piled along one side of the ditch, the apparatus comprising:

(a) vehicle adapted for movement relative to the ditch and the spoil;

(b) elevator assembly having side walls;

(c) spaced-apart guide projections extending forward from said elevator assembly whereby said projections define an open area in front of the elevator assembly, at least one of said spaced-apart guide projections having at least one rotary feeder assembly mounted thereon, said rotary feeder assembly having a rotor element with a base portion and a plurality of radially oriented raised structures for engaging and moving the spoil, whereby as said vehicle moves forward along the pile of spoil, said spaced-apart guide projections and said rotary feeder assembly assist in loading said elevator assembly while said elevator assembly transports the spoil to an elevated position;

(d) a separator for separating the spoil that is transported to the elevated position into fine material and rough material; and (e) a conveyor located at a position lower than the elevated position for conveying the fine material over the ditch whereby the fine material may be used for padding pipe laying in the ditch.

2. The apparatus of claim 1 wherein said elevator assembly is pivotally mounted to said vehicle and pivotally adjustable to control the amount of spoil loaded on said elevator assembly and transported to the elevated position.

3. The apparatus of claim 2 wherein said elevator assembly is pivotally mounted about at least two pivot points whereby the elevating assembly may be vertically adjusted relative to the piled spoil with a minimum of angular displacement.

4. The apparatus of claim 1 wherein said elevator assembly includes a closed, endless path of a plurality of spaced conveyor members.

5. The apparatus of claim 4 wherein said conveyor members are flat and adapted to be drawn across an elevator floor in order to transport spoil in the elevating direction.

6. The apparatus of claim 1 wherein said spaced-apart guide projections at the forward end of said elevator assembly are unitarily formed with said side walls of said elevator assembly.

7. The apparatus of claim 6 wherein each of said guide projections have a lower ground engaging surface that is formed to be substantially parallel to the surface upon which said vehicle rests, although the actual position of said ground engaging surface varies in accordance with the pivotal position of said elevator assembly.

8. The apparatus of claim 6 wherein each of said spaced-apart guide projections extend outwardly from said elevator assembly and have inner guide surfaces that is angled inwardly toward said elevator assembly.

9. The apparatus of claim 8 wherein said elevator assembly additionally comprises a cutting blade positioned at the front lower end thereof and extending between said spaced-apart guide projections to help separate a portion of the piled spoil from an underlying surface.

10. The apparatus of claim 9 wherein said spaced-apart guide projections are rigidly connected by an overhead structural support.

11. The apparatus of claim 10 wherein said overhead structural support additionally supports a hydraulic power supply, the weight of the power supply providing a downward force to the guide projections for assisting in maintaining the cutting blade at a predetermined depth in the spoil.

12. The apparatus of claim 1 wherein said separator comprises a plurality of spaced elements defining openings between said elements and wherein said elements are selectively spaced to allow fine material to pass between said spaced elements while preventing rough material from passing therebetween.

13. The apparatus of claim 1 additionally comprising a redepositing means for guiding the rough material from the elevated position back into the spoil pile at a location out of the forward path of the tracks of said vehicle.

14. The apparatus of claim 1 wherein said rotary feeder assembly is mounted to an inner guide surface of one of said spaced-apart guide projections.

15. The apparatus of claim 1 wherein said rotary feeder assembly is mounted to a lower portion of one of said spaced-apart guide projections whereby a rotor element is oriented substantially in a horizontal plane.

16. A method of padding pipe laying in an excavated ditch where the spoil from the excavated ditch is piled along one side of the ditch, the method comprising the steps of:

(a) continuously moving a vehicle along the side of the ditch having the spoil piled thereon;

(b) pivotally adjusting the position of an elevator assembly mounted to the vehicle, the elevator assembly having guide projections at the forward end thereof that extend forward of the vehicle so that as the vehicle moves forward along the pile, the guide projections assist in loading the elevator assembly and the elevator assembly transports spoil to an elevated position, the elevator assembly being pivotally adjusted to control the mount of spoil transported from the pile to the elevated position;

(c) mounting at least one rotary feeder assembly to said guide projections whereby said rotary feeder assembly assists in moving spoil material toward said elevator, said rotary feeder assembly having a rotor element with a base portion and a plurality of radially oriented raised structures for engaging and moving the spoil and mounting a motor to said guide projections for driving the rotor element;

(d) separating the elevated spoil into fine material and rough material;

(e) conveying the fine material into the excavated ditch; and (f) redepositing the rough material beside the ditch and behind the elevator assembly out of the forward path of the vehicle.

17. The apparatus of claim 1 wherein said radially oriented raised structures of said rotor element are formed of paddles.

18. The apparatus of claim 17 wherein said radially oriented paddles are removable whereby they can be replaced when they become worn.

* * * * *

UNITED STATES PATENT AND TRADEMARK OFFICE

CERTIFICATE OF CORRECTION

PATENT NO. : 5,430,962
DATED : JULY 11, 1995
INVENTOR(S) : OSADCHUK

It is certified that error appears in the above-indentified patent and that said Letters Patent is hereby corrected as shown below:

Column 2, line 29, "claim" should be -- claims --;
Column 3, line 55, "Fine" should be -- fine --;
Column 5, line 10, "FIGS" should be -- FIG. --;
Column 5, line 12, "fight" should be -- right --;
Column 7, line 54, "129" should be -- 128 --;
Column 7, line 54, "128" should be -- 129 --;
Column 9, line 59, "tint" should be -- first --;
Column 13, line 17, after "between" should be inserted -- "R," --;
Column 14, line 1, "fight" should be --right --;
Column 14, line 56, "tint" should be -- first --;
Column 16, line 31, "drum" should be -- drums --;
Column 17, line 26, "613,614" should be -- 613, 614 --;
Column 19, line 17, "mount" should be -- amount --.

Signed and Sealed this

Tenth Day of October, 1995

Bruce Lehman

*Attest:*

BRUCE LEHMAN

*Attesting Officer*

*Commissioner of Patents and Trademarks*